US012781492B2

(12) United States Patent
Lin et al.

(10) Patent No.: US 12,781,492 B2
(45) Date of Patent: Nov. 3, 2026

(54) TOILET AND WASTE DISCHARGE DEVICE THEREOF

(71) Applicant: QUANZHOU KOMOO INTELLIGENT KITCHEN & BATH CO., LTD, Quanzhou (CN)

(72) Inventors: Xiaofa Lin, Quanzhou (CN); Xiaoshan Lin, Quanzhou (CN); Shan Lin, Quanzhou (CN); Yanxin Xu, Quanzhou (CN); Rongrong Xu, Quanzhou (CN)

(73) Assignee: QUANZHOU KOMOO INTELLIGENT KITCHEN & BATH CO., LTD, Quanzhou (CN)

( * ) Notice: Subject to any disclaimer, the term of this patent is extended or adjusted under 35 U.S.C. 154(b) by 155 days.

(21) Appl. No.: 18/832,030

(22) PCT Filed: Dec. 27, 2022

(86) PCT No.: PCT/CN2022/142452
§ 371 (c)(1),
(2) Date: Jul. 22, 2024

(87) PCT Pub. No.: WO2023/151405
PCT Pub. Date: Aug. 17, 2023

(65) Prior Publication Data

US 2025/0116101 A1 Apr. 10, 2025

(30) Foreign Application Priority Data

Feb. 10, 2022 (CN) ..... 202210126279.2
Feb. 10, 2022 (CN) ..... 202220274102.2

(51) Int. Cl.
*E03D 11/13* (2006.01)
*E03D 11/04* (2006.01)
*E03D 11/06* (2006.01)

(52) U.S. Cl.
CPC ..... *E03D 11/13* (2013.01); *E03D 11/04* (2013.01); *E03D 11/06* (2013.01); *E03D 2201/20* (2013.01)

(58) Field of Classification Search
CPC ..... E03D 11/10; E03D 11/13; E03D 11/04; E03D 11/06; E03D 2201/20
See application file for complete search history.

(56) References Cited

U.S. PATENT DOCUMENTS 3,154,795 A * 11/1964 Burn ..... E03D 5/024 4/431
6,668,391 B1 * 12/2003 Lee ..... E03D 11/02 4/421

(Continued)

FOREIGN PATENT DOCUMENTS

CN 103290907 A 9/2013
CN 204311536 U 5/2015

(Continued)

OTHER PUBLICATIONS

Translation CN-112459189-A (Year: 2026).*

(Continued)

*Primary Examiner* — Janie M Loeppke
(74) *Attorney, Agent, or Firm* — BROOKS KUSHMAN P.C.

(57) ABSTRACT

A toilet and a waste discharge device thereof, where the waste discharge includes a pipeline assembly and a switching assembly. The pipeline assembly includes a water seal pipeline and a waste discharge pipeline. The waste discharge device has a waste discharge state and a water seal state. In the waste discharge state, the waste discharge pipeline is configured for toilet waste discharge. In the water seal state, the water seal pipeline is configured to water-seal the toilet. The switching assembly is configured to be capable of (Continued)

controlling the waste discharge device to switch between the waste discharge state and the water seal state.

17 Claims, 16 Drawing Sheets

(56) References Cited

U.S. PATENT DOCUMENTS

| | | | | |
|---|---|---|---|---|
| 12,478,226 | B2 * | 11/2025 | Hol | A47K 11/02 |
| 2015/0218788 | A1 | 8/2015 | Chen | |

FOREIGN PATENT DOCUMENTS

| | | | | | |
|---|---|---|---|---|---|
| CN | 204703271 | U | | 10/2015 | |
| CN | 106468068 | A | | 3/2017 | |
| CN | 106468073 | A | | 3/2017 | |
| CN | 107338845 | A | | 11/2017 | |
| CN | 108678116 | A | | 10/2018 | |
| CN | 111622321 | A | | 9/2020 | |
| CN | 112459189 | A | * | 3/2021 | E03D 11/13 |
| CN | 112942516 | A | | 6/2021 | |
| CN | 113550395 | A | * | 10/2021 | E03D 1/32 |
| CN | 114482219 | A | | 5/2022 | |
| CN | 217537227 | U | | 10/2022 | |
| EP | 3754123 | A1 | | 12/2020 | |
| JP | S57119863 | U | | 7/1982 | |
| JP | H01287331 | A | | 11/1989 | |
| JP | H0581379 | U | | 11/1993 | |
| JP | H06306921 | A | | 11/1994 | |
| JP | H07310355 | A | | 11/1995 | |
| JP | 2011012537 | A | | 1/2011 | |
| JP | 2015059368 | A | | 3/2015 | |
| JP | 2015520308 | A | | 7/2015 | |
| JP | 2017218843 | A | | 12/2017 | |
| KR | 20110029564 | A | | 3/2011 | |
| KR | 102082084 | B1 | | 2/2020 | |
| KR | 20200085576 | A | * | 7/2020 | E03D 11/10 |

OTHER PUBLICATIONS

Translation CN-113550395-A (Year: 2026).*
Translation KR-20200085576-A (Year: 2026).*
KIPO Office Action in KR Application No. 10-2024-7026202 dated Dec. 8, 2025 (19 pages, including English translation).
JPO Office Action in JP Application No. 2024-543505 dated Aug. 5, 2025 (15 pages, including English translation).
European Search Report for EP Application No. 22925754.8-1005 / 4446503 PCT/CN2022142452, dated Feb. 21, 2025, 8 pages.
International Search Report for International Application No. PCT/CN2022/142452, dated Feb. 22, 2023 (6 pages, including English translation).
CNIPA First Office Action in CN Application No. 202210126279.2 dated Mar. 17, 2023 (10 pages, including English translation).

* cited by examiner

TOILET AND WASTE DISCHARGE DEVICE THEREOF

CROSS-REFERENCE TO RELATED APPLICATIONS

This application is the U.S. National Phase of PCT Application No. PCT/CN2022/142452 filed on Dec. 27, 2022, which claims priorities to Chinese Patent Application Nos. 202210126279.2 and 202220274102.2, both filed on Feb. 10, 2022, the disclosures of which are hereby incorporated herein by reference in their entireties.

TECHNICAL FIELD

The present disclosure relates to, but is not limited to, the field of toilets, and particularly relates to, but is not limited to, a sewage discharge device of a toilet and the toilet including the sewage discharge device.

BACKGROUND

In some cases, a toilet without a water tank or a toilet with a water tank basically cleans a ceramic bowl surface of the toilet by discharging water from a brush ring port, removes excrement in the toilet by spraying water from a spray port, and at the same time, realizes a sewage discharge function by utilizing a siphon function generated by a S-bend channel of a ceramic toilet itself.

SUMMARY

The following is a summary of the subject matter described in detail herein. This summary is not intended to limit the protection scope of the claims.

A sewage discharge device of a toilet includes a pipeline assembly and a switching assembly, and the pipeline assembly includes a water seal channel and a sewage discharge channel. The sewage discharge device has a sewage discharge state and a water seal state, and in the sewage discharge state, the sewage discharge channel is configured for discharging sewage from the toilet; in the water seal state, the water seal channel is configured to water-seal the toilet. The switching assembly is configured to control the sewage discharge device to switch between the sewage discharge state and the water seal state.

A toilet includes a toilet body and the sewage discharge device of the toilet described above, the toilet body has a sewage discharge port, and an inlet end of the sewage discharge channel of the sewage discharge device and an inlet end of the water seal channel of the sewage discharge device are both communicated with the sewage discharge port.

Other aspects will become apparent after reading and understanding the drawings and detailed description.

BRIEF DESCRIPTION OF THE DRAWINGS

The drawings are used for providing a further understanding of technical solutions of the present disclosure, and constitute a part of the specification. They are used together with embodiments of the present disclosure to explain the technical solutions of the present disclosure, and do not constitute a restriction on the technical solutions of the present disclosure.

REFERENCE SIGNS

Figure 1:
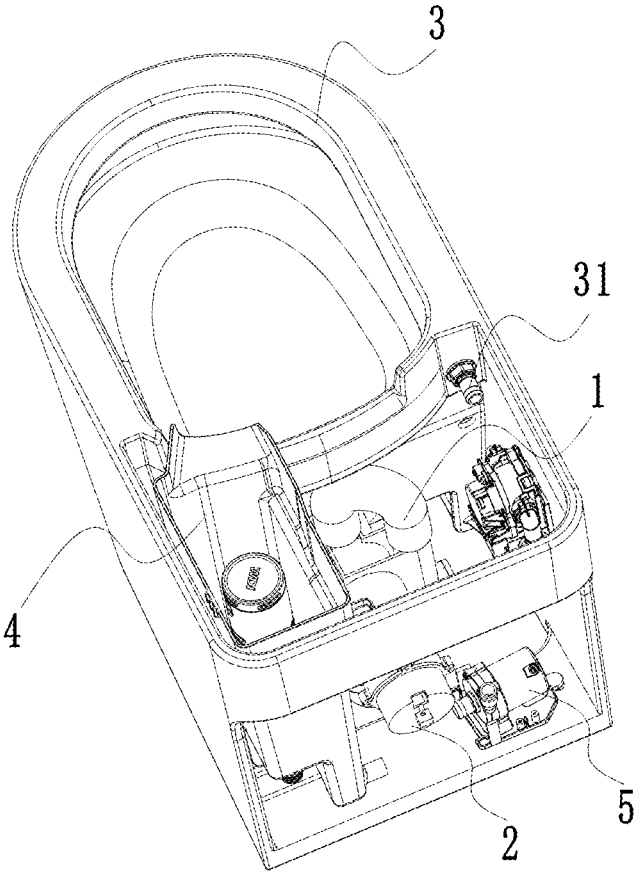
FIG. 1 is a schematic diagram of a three-dimensional structure of a toilet according to an embodiment of the present application.
Figure 2:
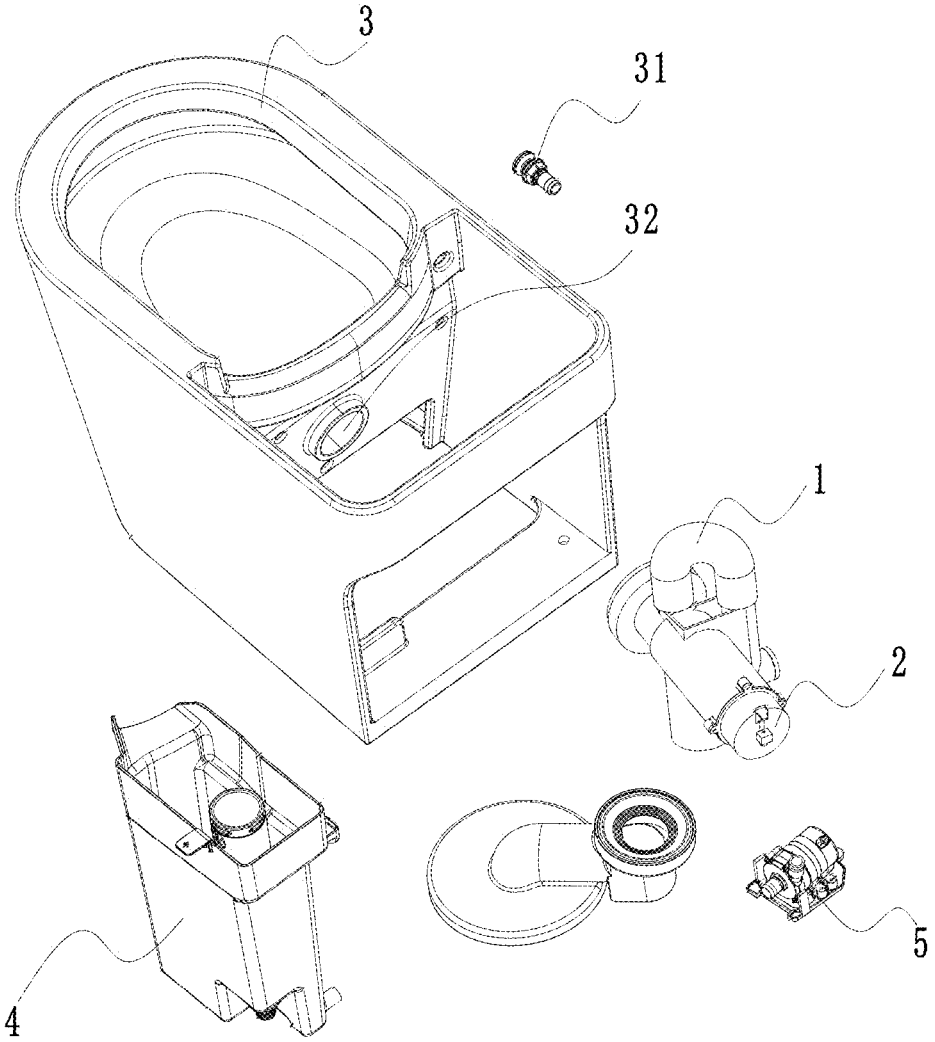
FIG. 2 is a schematic exploded view of a structure of the toilet shown in FIG. 1.

1: pipeline assembly, 11: sewage discharge channel, 111: first inlet end, 112: first outlet end, 113: first sewage discharge sub-channel, 114: second sewage discharge sub-channel, 12: water seal channel, 121: second inlet end, 122: second outlet end, 13: matching part, 14: pipeline main body, 141: first port, 142: second port, 143: first water seal sub-channel, 15: U-shaped tube, 16: filter screen, 17: mounting cavity, 18: plug;

2: switching assembly, 21: sealing piston, 211: sealing rubber pad, 212: rubber pad bracket, 22: electric telescopic rod, 221: fixing block, 23: end cap, 231: fluid inlet, 24: elastic element, 251: pressure relief channel, 252: pressure relief valve, 261: gear, 262: rack, 27: fixing seat, 271: fluid outlet, 28: sealing cavity; 29 ball valve; 291: flow passage; 292: valve core;

3: toilet body, 31: brush ring water inlet, 32: sewage discharge port;

4: water tank;

5: water pump.

DETAILED DESCRIPTION

Technical solutions in embodiments of the present application will be clearly and completely described below with reference to the drawings in the embodiments of the present application. Apparently, the described embodiments are only part of and not all of the embodiments of the present application. Based on the embodiments of the present application, all other embodiments obtained by those of ordinary skills in the art without making creative efforts fall within the scope of protection of the present application.

In addition, the technical solutions between the different embodiments of the present application may be combined with each other, but it needs to be based on the realization by those of ordinary skills in the art. When the combination of technical solutions is contradictory or cannot be realized, it should be considered that such combination of technical solutions does not exist, and is not within the scope of protection claimed by the present application.

In the description of the present application, it is to be understood that the orientations or position relationships indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise" and the like are based on those shown in the drawings, which are only for convenience of describing the present application and simplifying the description and are not intended to indicate or imply that the referred device or element must have a particular orientation, or is constructed and operated in a particular orientation and therefore cannot be construed as a limitation on the present application.

Furthermore, the terms "first", "second" are only used for descriptive purposes and cannot be understood to indicate or imply relative importance or imply the number of technical features indicated.

In the description of the present application, unless otherwise expressly specified and limited, the terms "installation", "coupling", "connection" shall be understood in a broad sense, for example, may be a fixed connection, may be a detachable connection, or may be an integrated connection. It may be a mechanical connection, or an electrical connection, or an intercommunication. It may be a direct connection, or an indirect connection through an intermediate medium, or an internal communication between two elements, or an interaction relationship between two elements. For those of ordinary skills in the art, specific meanings of the above terms in the present application can be understood according to specific situations.

In the present application, unless otherwise expressly specified and limited, the first feature being "above" or "below" the second feature may be a direct contact between the first and second features, or may include the first and second features being not in direct contact but in contact by another feature between them. Moreover, the first feature being "on", "above" and "over" the second feature may include the first feature being directly above and obliquely above the second feature, or simply indicate that the level of the first feature is higher than that of the second feature. The first feature being "under", "below" and "underneath" the second feature may include the first feature being directly below and obliquely below the second feature, or simply indicate that the level of the first feature is lower than that of the second feature.

The disclosure below provides many different implementations or examples for implementing different structures of the present application. In order to simplify the disclosure of the present application, components and arrangements of particular examples are described below. Of course, they are merely examples and are not intended to limit the present application. In addition, the present application may repeat reference numbers and/or reference letters in different examples, such repetition is for simplification and clarity purposes and not per se indicative of a relationship between the various embodiments and/or settings discussed. In addition, the present application provides various examples of specific processes and materials, but those of ordinary skills in the art may be aware of the application of other processes and/or the use of other materials.

In some cases, a toilet flushing system that utilizes cooperation between the spray port and the S-bend channel to discharge sewage has the following problems:

1. sewage discharge mainly utilizes a large water flow sprayed from the spray port to spray excrement into the S-bend channel, which is noisy;
2. the S-bend channel needs to be integrally formed with a ceramic toilet body, which has a complicated process and a high cost;
3. although the S-bend channel may produce a siphon effect and may effectively discharge sewage, there is still a problem that a sewage discharge capacity is insufficient, and it cannot be discharged fully when there is larger excrement and a greater amount of excrement.

As shown in FIGS. 1-12, an embodiment of the present application provides a sewage discharge device of a toilet, including a pipeline assembly 1 and a switching assembly 2.

The pipeline assembly 1 includes a water seal channel 12 and a sewage discharge channel 11, and an inlet end of the sewage discharge channel 11 and an inlet end of the water seal channel 12 are communicable with a sewage discharge port 32 (described in detail below) of a toilet body 3. The sewage discharge device has a sewage discharge state and a water seal state, in the sewage discharge state, the sewage discharge channel 11 is configured for discharging sewage from the toilet body 3, and in the water seal state, the water seal channel 12 is configured to water-seal the toilet body 3.

The switching assembly 2 is configured to control the sewage discharge device to switch between the sewage discharge state and the water seal state. When the switching assembly 2 controls the sewage discharge device to be in the water seal state, the water seal channel 12 is communicated with the sewage discharge port 32 of the toilet body 3, so that the toilet body 3 may be water-sealed to isolate odor. When the switching assembly 2 controls the sewage discharge device to be in the sewage discharge state, the sewage discharge channel 11 is communicated with the sewage discharge port 32 of the toilet body 3, and the sewage discharge channel 11 may be used for discharging sewage from the toilet body 3 at this time, and excrement in the toilet body 3 may be discharged through the sewage discharge channel 11.

In the sewage discharge device according to an embodiment of the present application, the water seal function is realized through the water seal channel 12, the sewage discharge function is realized through the sewage discharge channel 11, and the switching assembly 2 realizes a switching between the water seal state and the sewage discharge state of the sewage discharge device, the sewage discharge function is realized without using siphon, noise of the toilet is reduced when the toilet is flushed, and excrement in the toilet body 3 can be removed completely. In addition, the pipeline assembly 1 of the sewage discharge device and the toilet body 3 can be formed separately, and assembled and connected together, thereby reducing the difficulty of a forming process of the toilet body 3 and reducing the processing cost.

Figure 3:
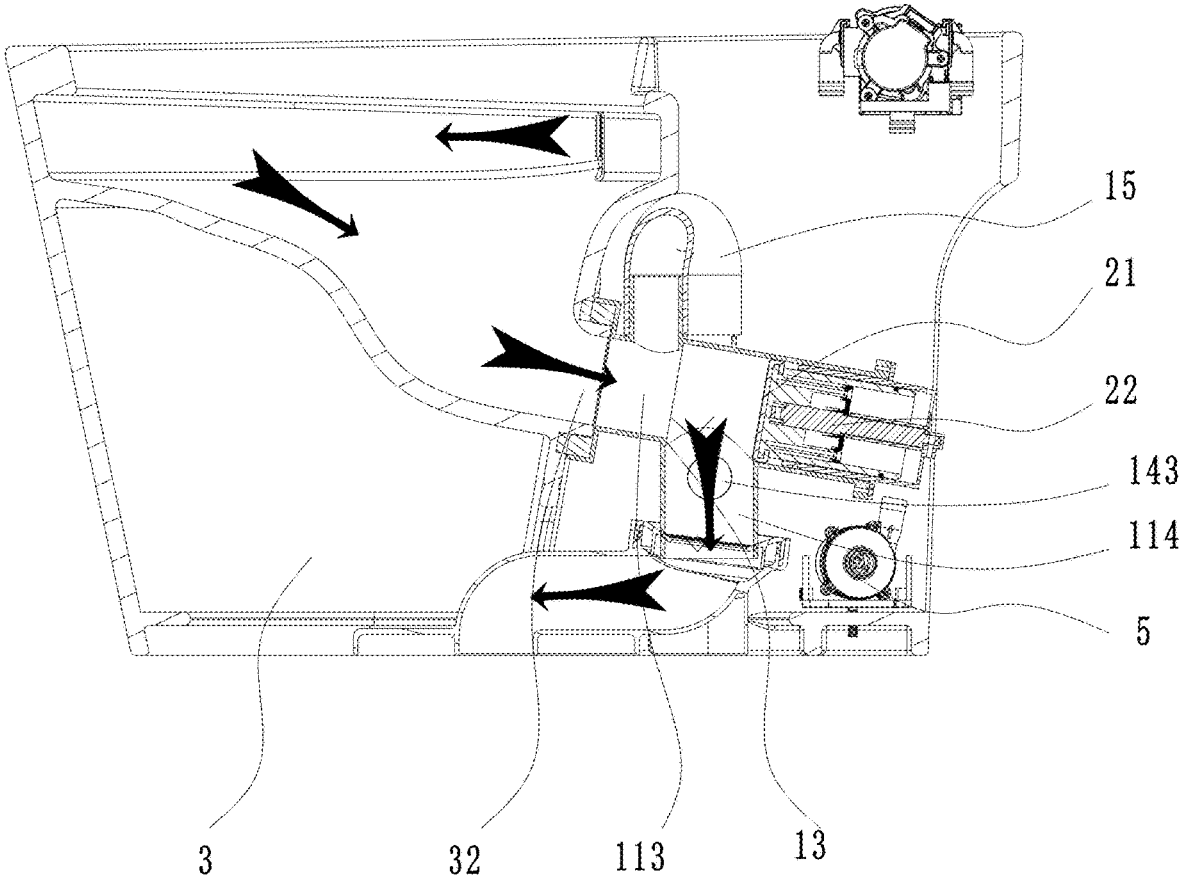
FIG. 3 is a first schematic sectional view of a structure of the toilet shown in FIG. 1, in which the sewage discharge channel is communicated.
Figure 4:
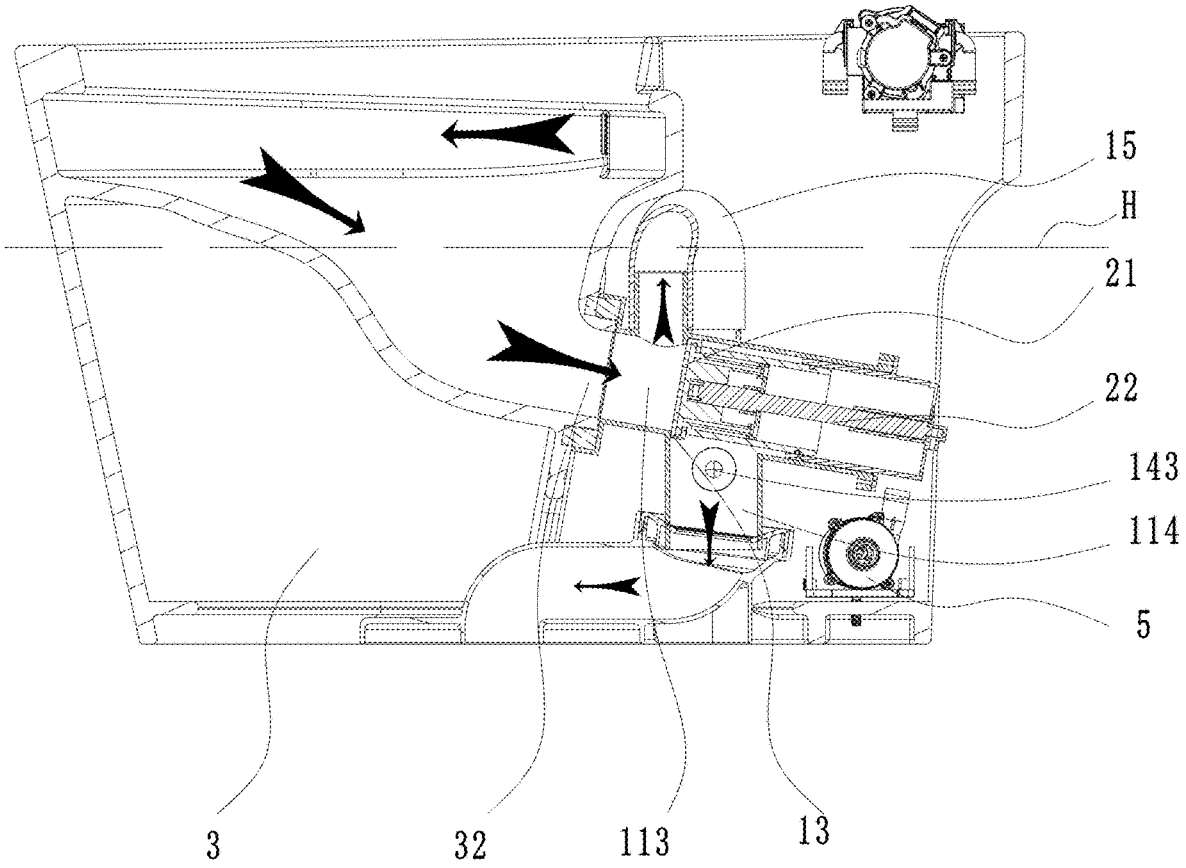
FIG. 4 is a second schematic sectional view of a structure of the toilet shown in FIG. 1, in which the sewage discharge channel is discommunicated.
Figure 5:
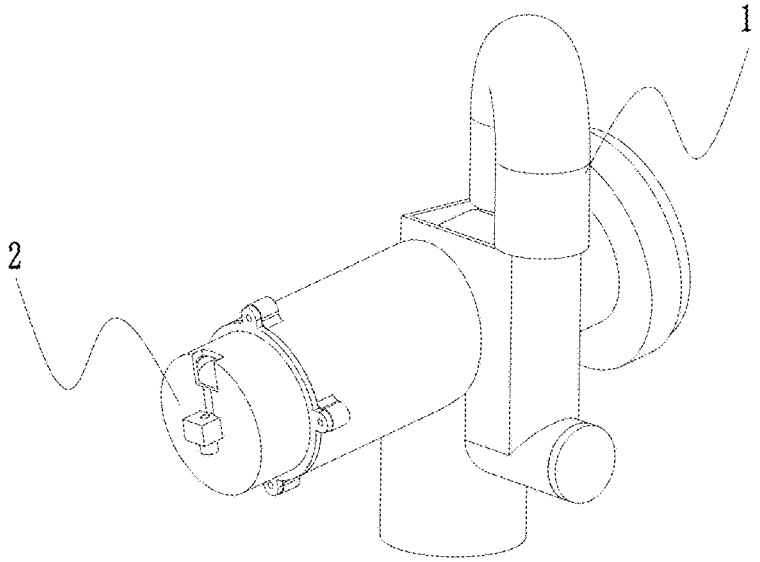
FIG. 5 is a schematic diagram of a three-dimensional structure of a sewage discharge device of the toilet shown in FIG. 1.
Figure 9:
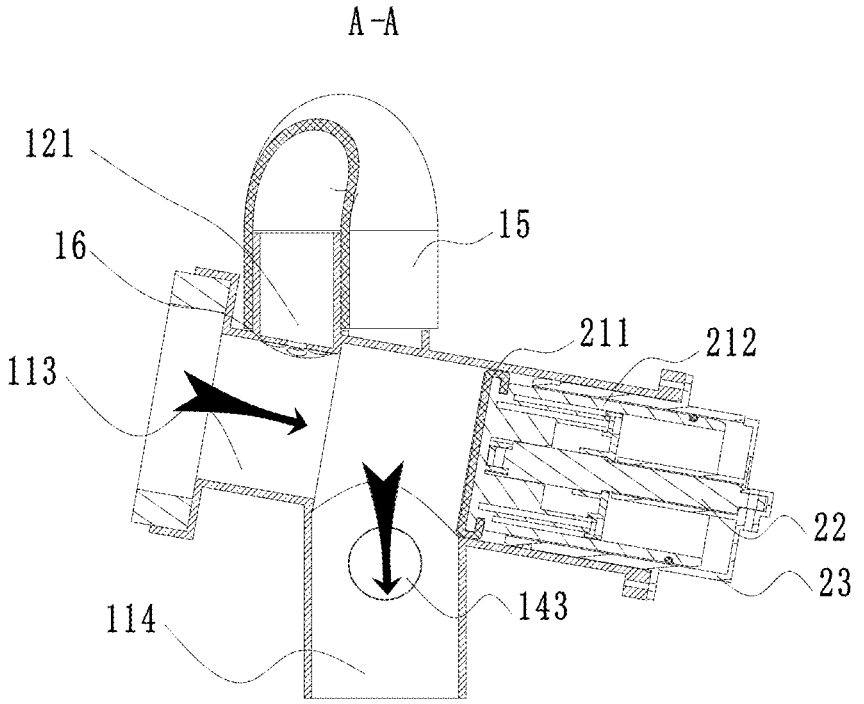
FIG. 9 is a schematic sectional view of a structure taken along an A-A direction in FIG. 8.
Figure 11:
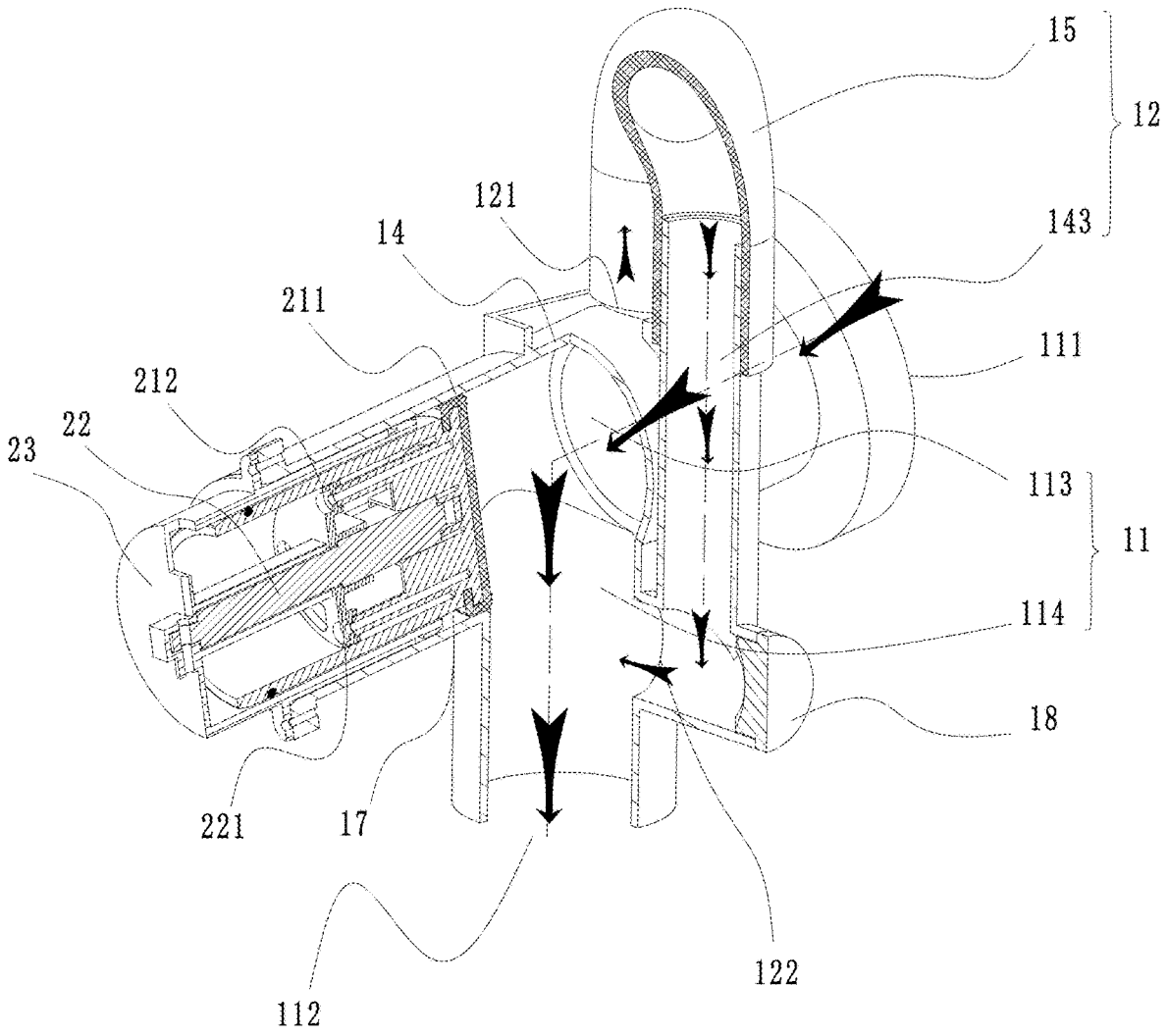
FIG. 11 is a first schematic sectional view of a structure of the sewage discharge device shown in FIG. 5, in which the sewage discharge channel is communicated.
Figure 12:
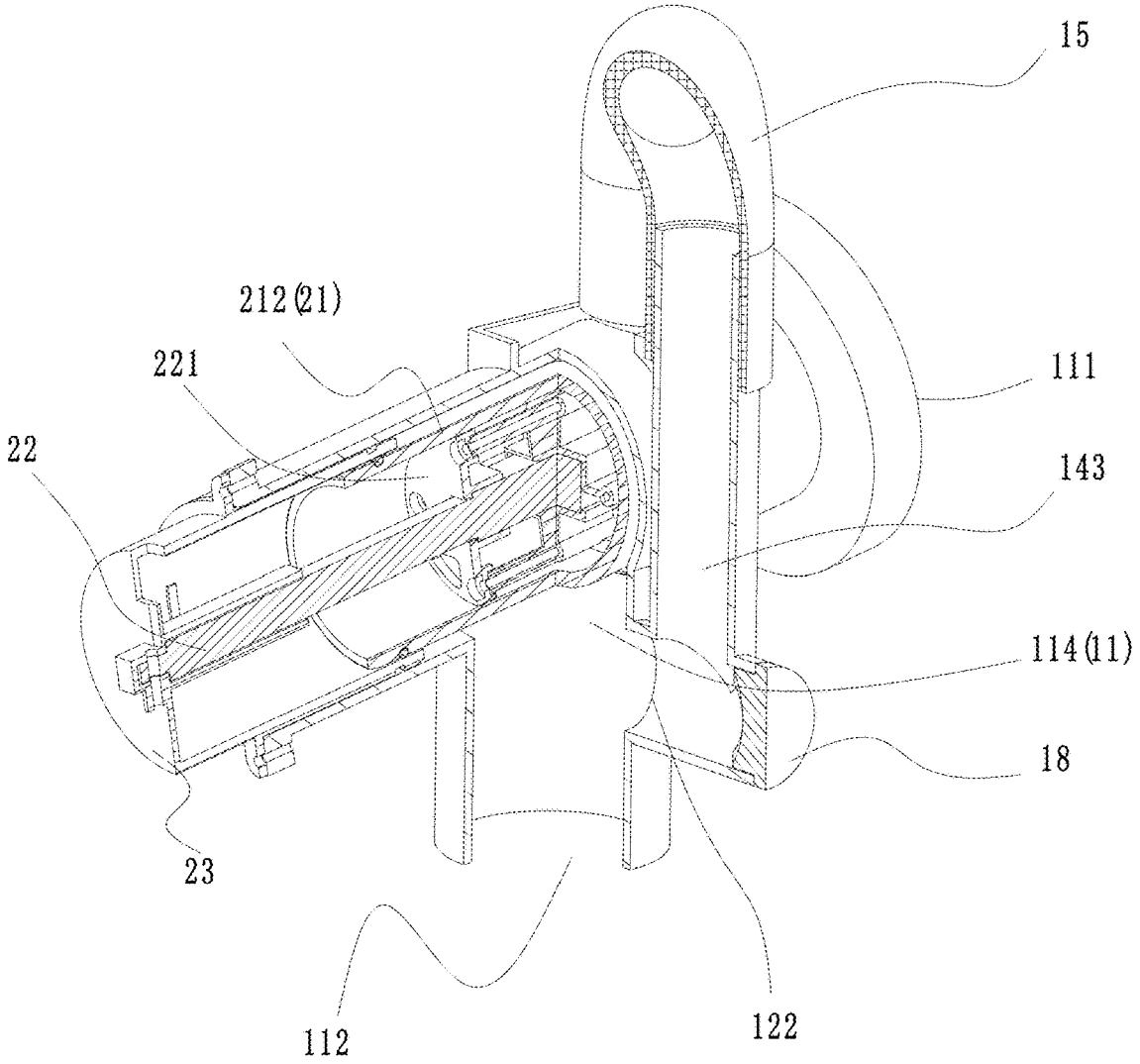
FIG. 12 is a second schematic sectional view of a structure of the sewage discharge device shown in FIG. 5, in which the sewage discharge channel is discommunicated.

In some exemplary embodiments, as shown in FIGS. 3-4, 9, and 11-12, the sewage discharge channel 11 has an inlet end (i.e., a first inlet end 111) and an outlet end (i.e., a first outlet end 112), and a matching part 13 is provided in the sewage discharge channel 11 and cooperates with the switching assembly 2, the switching assembly 2 is configured to control the communication (as shown in FIGS. 3, 9, and 11) or discommunication (as shown in FIGS. 4 and 12) of the sewage discharge channel 11, that is, the switching assembly 2 may be cooperated with the matching part 13 to communicate or discommunicate the sewage discharge channel 11 so that the sewage discharge device is in the sewage discharge state or the water seal state.

As shown in FIGS. 11-12, the water seal channel 12 has an inlet end (i.e., a second inlet end 121) and an outlet end (i.e., a second outlet end 122). The inlet end (i.e., a second inlet end 121) of the water seal channel 12 is communicated with a portion of the sewage discharge channel 11 located upstream of the matching part 13, i.e., the matching part 13 is located downstream of a communication part between the sewage discharge channel 11 and the second inlet end 121 of the water seal channel 12, and a highest point of the water seal channel 12 is higher than a highest point of the sewage discharge channel 11.

When the sewage discharge channel 11 is discommunicated, the water seal channel 12 is configured to water-seal the toilet. When the sewage discharge channel 11 is communicated, the sewage discharge channel 11 is configured for discharging sewage from the toilet.

According to an embodiment of the present application, the pipeline assembly 1 of the sewage discharge device includes the sewage discharge channel 11 and the water seal channel 12, the first inlet end 111 of the sewage discharge channel 11 is communicable with the sewage discharge port 32 of the toilet body 3, and the matching part 13 of the sewage discharge channel 11 may be cooperated with the switching assembly 2 so that the sewage discharge channel 11 is communicated or discommunicated by the switching assembly 2. The second inlet end 121 of the water seal channel 12 is communicable with the sewage discharge channel 11, and the communication part is located upstream of the matching part 13. As a result, the water seal channel 12 is always communicated with the sewage discharge port 32 of the toilet body 3. The highest point of the water seal channel 12 is higher than the highest point of the sewage discharge channel 11, so that when the sewage discharge channel 11 is discommunicated by the switching assembly 2, the water seal channel 12 may water-seal the toilet body 3 to isolate odor; and when the sewage discharge channel 11 is communicated by the switching assembly 2, since the highest point of the sewage discharge channel 11 is lower than the highest point of the water seal channel 12, the sewage discharge channel 11 may be configured for discharging sewage from the toilet, and excrement in the toilet body 3 may be discharged through the sewage discharge channel 11 and will not remain in the water seal channel 12.

In the sewage discharge device according to an embodiment of the present application, the water seal function is realized through the water seal channel 12, the sewage discharge function is realized through the sewage discharge channel 11, and the communication and discommunication of the sewage discharge channel 11 is realized through the switching assembly 2, which realizes the sewage discharge function without using siphon, noise of the toilet is reduced when the toilet is flushed, and excrement in the toilet body 3 can be removed completely. In addition, the pipeline assembly 1 of the sewage discharge device and the toilet body 3 can be formed separately and assembled and connected together, thereby reducing the difficulty of a forming process of the toilet body 3 and reducing the processing cost.

It should be understood that the second inlet end 121 of the water seal channel 12 may not be communicated with the sewage discharge channel 11, but the first inlet end 111 of the sewage discharge channel 11 and the second inlet end 121 of the water seal channel 12 may be arranged side by side, by switching the switching assembly 2, the connection and disconnection between the first inlet end 111 of the sewage discharge channel 11 and the sewage discharge port 32 are realized, and the connection and disconnection between the second inlet end 121 of the water seal channel 12 and the sewage discharge port 32 are realized.

In some exemplary embodiments, as shown in FIGS. 11-12, the outlet end (i.e., the second outlet end 122) of the water seal channel 12 is communicated with a portion of the sewage discharge channel 11 located downstream of the matching part 13.

The portion where the second outlet end 122 of the water seal channel 12 is communicated with the sewage discharge channel 11 is located downstream of the matching part 13, so that when the sewage discharge channel 11 is closed by the switching assembly 2, the second outlet end 122 of the water seal channel 12 remains communication with the first outlet end 112 of the sewage discharge channel 11, excess water in the toilet body 3 may overflow from the sewage discharge channel 11 after passing through the water seal channel 12, and the water in the toilet body 3 may be maintained at the water seal level to meet the water seal requirements.

Of course, the second outlet end 122 of the water seal channel 12 may not be configured to be communicated with a portion of the sewage discharge channel 11 located downstream of the matching part 13, but the second outlet end 122 of the water seal channel 12 may be configured to be suspended, which does not affect the water seal function of the water seal channel 12.

In some exemplary embodiments, as shown in FIGS. 11-12, the second outlet end 122 of the water seal channel 12 is provided close to the first outlet end 112 of the sewage discharge channel 11.

The second outlet end 122 of the water seal channel 12 may be provided close to the first outlet end 112 of the sewage discharge channel 11. Since a position of the first outlet end 112 of the sewage discharge channel 11 is lower, a position of the second outlet end 122 of the water seal channel 12 is lower, and there is a large height difference between the second outlet end 122 and a highest point of the water seal channel 12. As a result, when the sewage discharge channel 11 is communicated by the switching assembly 2 for discharging sewage, the water seal channel 12 may generate siphon, thereby causing foreign matter to enter the water seal channel 12. Therefore, a filter screen 16 may be provided at the second inlet end 121 of the water seal channel 12 to prevent foreign matter from entering the water seal channel 12 and blocking the water seal channel 12 while ensuring the water seal and water overflow.

In this exemplary embodiment, as shown in FIGS. 5-12, the pipeline assembly 1 includes a pipeline main body 14 and a U-shaped tube 15. The pipeline main body 14 is provided with a sewage discharge channel 11, a first water seal sub-channel 143, a first port 141, and a second port 142. The first port 141 is communicated with a portion of the sewage discharge channel 11 located upstream of the matching part 13. The second port 142 is communicated with a portion of the sewage discharge channel 11 located downstream of the matching part 13 through the first water seal sub-channel 143. Two ends of the U-shaped tube 15 are respectively communicated with the first port 141 and the second port 142. The channel in the U-shaped tube 15 and the first water seal sub-channel 143 form the water seal channel 12.

In the pipeline assembly 1, the sewage discharge channel 11 and the first water seal sub-channel 143 are provided in the pipeline main body 14. The pipeline main body 14 is further provided with the first port 141 and the second port 142, the first port 141 is communicated with the portion of the sewage discharge channel 11 located upstream of the matching part 13, and the second port 142 is communicated with one end of the first water seal sub-channel 143. The other end of the first water seal sub-channel 143 is communicated with the portion of the sewage discharge channel 11 located downstream of the matching part 13. As a result, a communication between the second port 142 and the portion of the sewage discharge channel 11 located downstream of the matching part 13 is realized through the first water seal sub-channel 143. The two ends of the U-shaped tube 15 are respectively communicated with the first port 141 and the second port 142, so that the channel in the U-shaped tube 15 is communicated with the first water seal sub-channel 143 to form the water seal channel 12, the water seal channel 12 is communicated with the sewage discharge channel 11, and the communication portions between the water seal channel 12 and the sewage discharge channel 11 are respectively located upstream and downstream of the matching part 13, so as not to affect the water seal and water overflow functions of the water seal channel 12.

Figure 6:
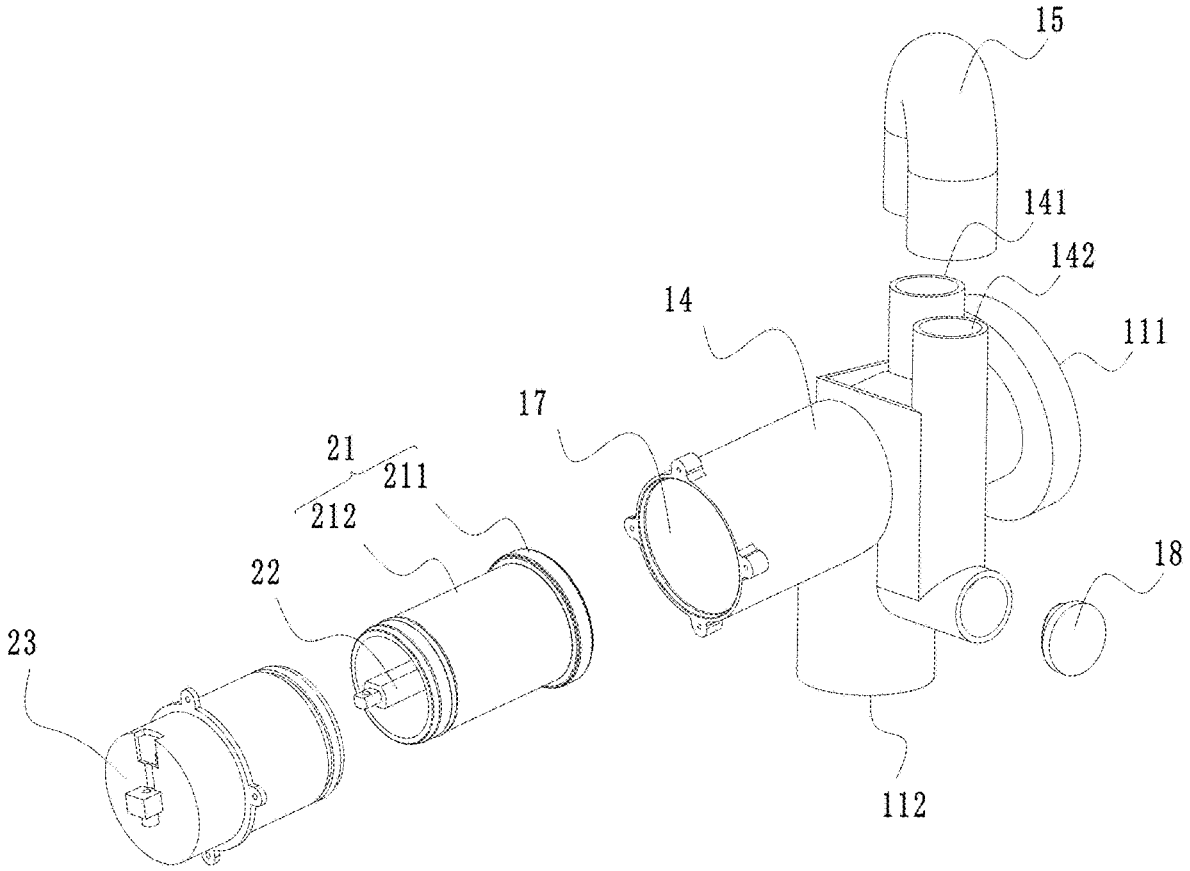
FIG. 6 is a schematic exploded view of a structure of the sewage discharge device shown in FIG. 5.
Figure 7:
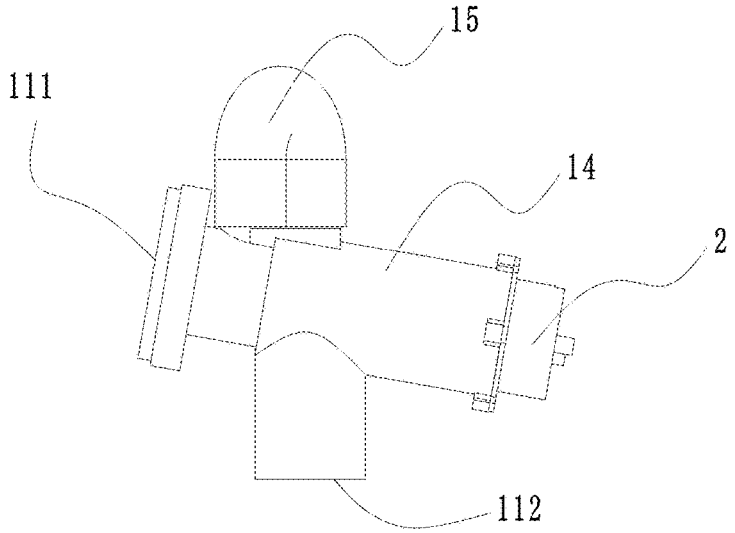
FIG. 7 is a schematic front view of a structure of the sewage discharge device shown in FIG. 5.
Figure 8:
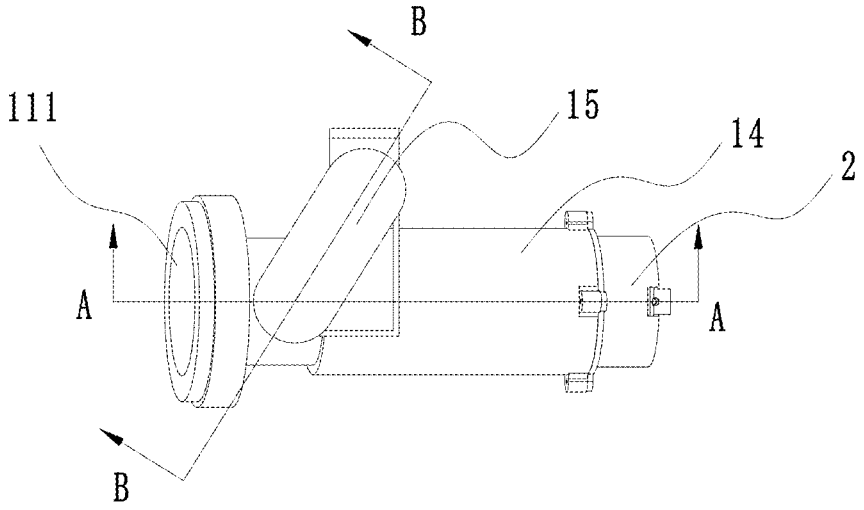
FIG. 8 is a schematic top view of a structure of the sewage discharge device shown in FIG. 5.
Figure 10:
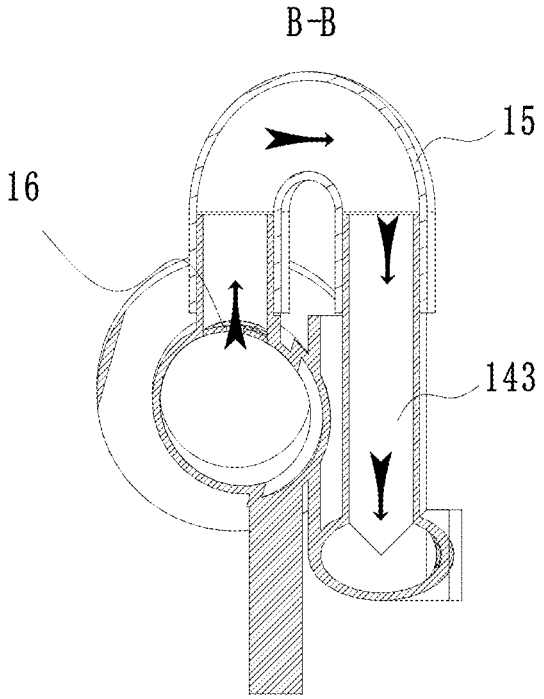
FIG. 10 is a schematic sectional view of a structure taken along a B-B direction in FIG. 8.

As shown in FIG. 6, the first port 141 and the second port 142 of the pipeline main body 14 are located at an upper part of the pipeline main body 14. The U-shaped tube 15 is invertedly provided, and two downward-facing ends of the U-shaped tube 15 are respectively connected to the first port 141 and the second port 142. The U-shaped tube 15 may be a hose, and two ends of the U-shaped tube 15 are respectively sleeved outside the first port 141 and the second port 142 and are interference-fitted with the first port 141 and the second port 142, so that sealed connections between the U-shaped tube 15 and the first port 141 and between the U-shaped tube 15 and the second port 142 are realized, which prevents water leakage at the connection parts. As shown in FIGS. 10 and 11, the first water seal sub-channel 143 is provided vertically as a whole, and a communication part between the first water seal sub-channel 143 and the sewage discharge channel 11 is provided close to the first outlet end 112 of a lower part of the sewage discharge channel 11. A highest point of the inverted U-shaped tube 15 forms a highest point of the water seal channel 12 (i.e., the overflow point of the water seal channel 12), and is higher than a highest point of the sewage discharge channel 11 in the pipeline main body 14 and higher than a height of the water seal level H of the toilet body 3 (see FIG. 4), so as to realize the water seal function of the water seal channel 12.

As shown in FIGS. 9 and 11-12, the sewage discharge channel 11 includes a first sewage discharge sub-channel 113 and a second sewage discharge sub-channel 114, the first sewage discharge sub-channel 113 is provided transversely, and the second sewage discharge sub-channel 114 is provided vertically. One end of the first sewage discharge sub-channel 113 and one end of the second sewage discharge sub-channel 114 are connected in an inverted L-shape. The other end of the first sewage discharge sub-channel 113 forms the first inlet end 111 of the sewage discharge channel 11 and the other end of the second sewage discharge sub-channel 114 forms the first outlet end 112 of the sewage discharge channel 11. The first sewage discharge sub-channel 113 is inclined downwards along a flow direction of flushing water flowing in the sewage discharge channel 11, so that sewage in the toilet body 3 is discharged through the sewage discharge channel 11 under an action of the flushing water.

The first port 141 is communicated with the first sewage discharge sub-channel 113, and a communication between the second port 142 and the second sewage discharge sub-channel 114 is realized through the first water seal sub-channel 143. The matching part 13 in the sewage discharge channel 11 may be provided at a connection part where the first sewage discharge sub-channel 113 is connected with the second sewage discharge sub-channel 114, so that the first port 141 is located upstream of the matching art 13, and a communication part between the first water seal sub-channel 143 and the second sewage discharge sub-channel 114 is located downstream of the matching part 13, the second inlet end 121 (one end of the U-shaped tube 15 connected to the first port 141) and the second outlet end 122 (one end of the first water seal sub-channel 143 connected to the second sewage discharge sub-channel 114) of the water seal channel 12 are respectively located upstream and downstream of the matching part 13.

The pipeline main body 14 may be of an integrally formed structure. As shown in FIGS. 6, and 11-12, in order to facilitate forming, an opening in external communication with the pipeline main body 14 is provided at the middle part of the first water seal sub-channel 143, and the opening is sealed by a plug 18.

Figure 13:
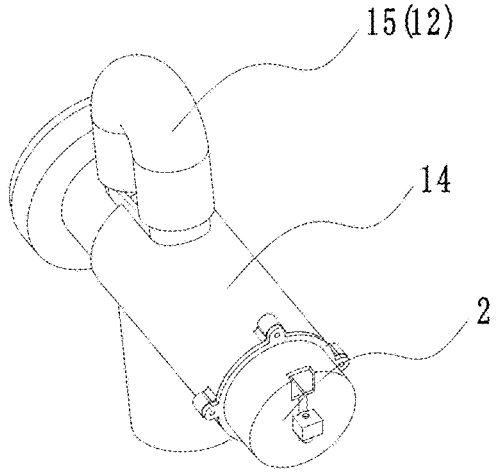
FIG. 13 is a schematic diagram of a three-dimensional structure of a sewage discharge device of a toilet according to another embodiment of the present application.
Figure 14:
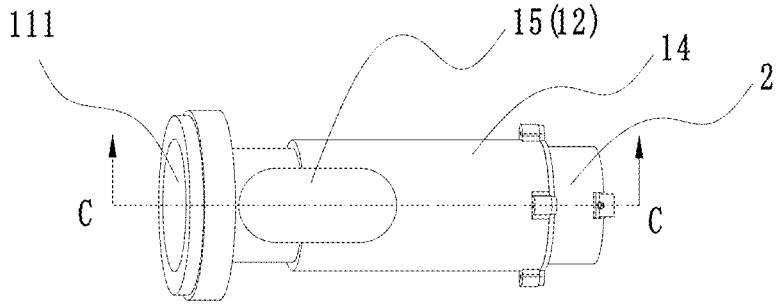
FIG. 14 is a schematic top view of a structure of the sewage discharge device shown in FIG. 13.
Figure 15:
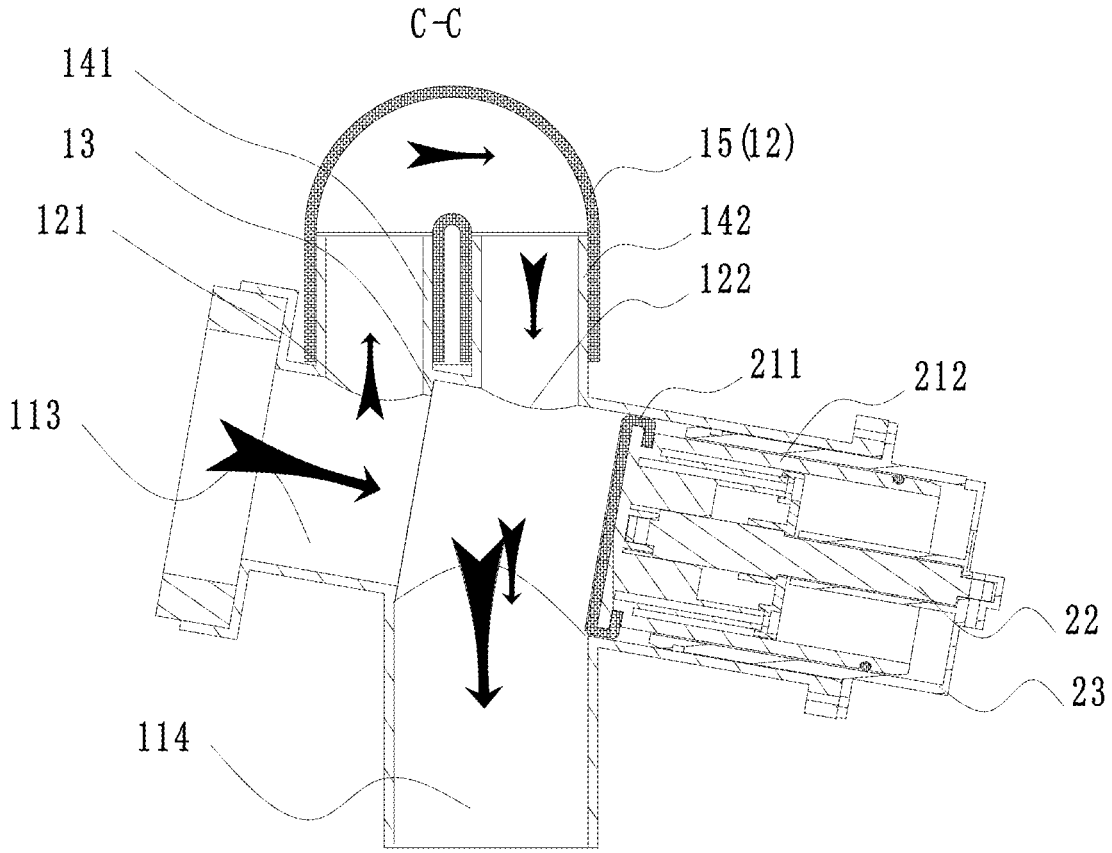
FIG. 15 is a schematic sectional view of a structure taken along a C-C direction in FIG. 14.

In some other exemplary embodiments, as shown in FIGS. 13-15, the second outlet end 122 of the water seal channel 12 is provided close to the matching part 13.

The second outlet end 122 of the water seal channel 12 may be provided close to the matching part 13 in the sewage discharge channel 11. Since a position of the matching part 13 is higher than a position of the first outlet end 112 of the sewage discharge channel 11, so that a position of the second outlet end 122 of the water seal channel 12 is higher, when the sewage discharge channel 11 is communicated by the switching assembly 2 for discharging sewage, the water seal channel 12 may not generate siphon and foreign matter does not enter the water seal channel 12. Therefore, it is not necessary to provide a filter screen 16 at the second inlet end 121 of the water seal channel 12. Optionally, a filter screen 16 may be provided at the second inlet end 121 of the water seal channel 12 to ensure that foreign matter does not enter the water seal channel 12 or block the water seal channel 12.

In this exemplary embodiment, as shown in FIGS. 13-15, the pipeline assembly 1 includes the pipeline main body 14 and the U-shaped tube 15. The pipeline main body 14 is provided with the sewage discharge channel 11, the first port 141, and the second port 142. The first port 141 and the second port 142 are communicated with the sewage discharge channel 11, and the first port 141 and the second port 142 are respectively located upstream and downstream of the matching part 13. Two ends of the U-shaped tube 15 are respectively communicated with the first port 141 and the second port 142. The channel in the U-shaped tube 15 forms the water seal channel 12.

In the pipeline assembly 1, the sewage discharge channel 11 is provided in the pipeline main body 14, and the pipeline main body 14 is further provided with the first port 141 and the second port 142 respectively located upstream and downstream of the matching part 13. Two ends of the U-shaped tube 15 are respectively communicated with the first port 141 and the second port 142, so that a communication between the water seal channel 12 formed in the U-shaped tube 15 and the sewage discharge channel 11 is realized through the first port 141 and the second port 142, and communication parts between the U-shaped tube 15 and the sewage discharge channel 11 are respectively located upstream and downstream of the matching part 13, so as not to affect the water seal and the water overflow functions of the water seal channel 12.

As shown in FIG. 15, the first port 141 and the second port 142 of the pipeline main body 14 are located at an upper part of the pipeline main body 14, the U-shaped tube 15 is invertedly provided, and two downward-facing ends of the U-shaped tube 15 are respectively connected to the first port 141 and the second port 142. The U-shaped tube 15 may be a hose, and two ends of the U-shaped tube 15 are respectively sleeved outside the first port 141 and the second port 142 and are interference-fitted with the first port 141 and the second port 142, so that sealed connections between the U-shaped tube 15 and the first port 141 and between the U-shaped tube 15 and the second port 142 are realized, which prevents water leakage at the connection parts. A highest point of the inverted U-shaped tube 15 forms a highest point of the water seal channel 12, and is higher than a highest point of the sewage discharge channel 11 in the pipeline main body 14 and higher than a height of the water seal level H of the toilet body 3, so as to realize the water seal function of the water seal channel 12.

As shown in FIG. 15, the sewage discharge channel 11 includes a first sewage discharge sub-channel 113 and a second sewage discharge sub-channel 114, the first sewage discharge sub-channel 113 is provided transversely, and the second sewage discharge sub-channel 114 is provided vertically. The first sewage discharge sub-channel 113 and the second sewage discharge sub-channel 114 are connected in an inverted L-shape, and the first port 141 and the second port 142 are both communicated with the first sewage discharge sub-channel.

In the sewage discharge channel 11, the first sewage discharge sub-channel 113 provided transversely is communicated with one end of the second sewage discharge sub-channel provided vertically and an inverted L-shape is presented. The other end of the first sewage discharge sub-channel 113 forms the first inlet end 111 of the sewage discharge channel 11, and the other end of the second sewage discharge sub-channel 114 forms the first outlet end 112 of the sewage discharge channel 11. The first sewage discharge sub-channel 113 is inclined downwards along a flow direction of flushing water flowing in the sewage discharge channel 11, so that sewage in the toilet body 3 is discharged through the sewage discharge channel 11 under an action of the flushing water.

The first port 141 and the second port 142 connected to the U-shaped tube 15 are both communicated with the first sewage discharge sub-channel 113, and the matching part 13 is located between the first port 141 and the second port 142, so that the first port 141 and the second port 142 are respectively located upstream and downstream of the matching part 13.

The pipeline main body 14 may be of an integrally formed structure.

In some exemplary embodiments, the switching assembly includes a switching component, and the switching component is configured to be able to rotate or translate to switch between a first position and a second position. When the switching component is in the first position, the sewage discharge channel is discommunicated, and when the switching component is in the second position, the sewage discharge channel is communicated.

The switching component of the switching assembly 2 may rotate forwardly and reversely or translate reciprocally, so that the switching component may switch between the first position and the second position. When the switching component moves to the first position, the sewage discharge channel 11 may be discommunicated, and at this time the water seal channel 12 may conduct water-seal, and when the switching component moves to the second position, the sewage discharge channel 11 is communicated and sewage discharge is realized.

In some exemplary embodiments, as shown in FIGS. 6, 9, 11-12, and 15, a mounting cavity 17 for mounting a switching assembly 2 is provided in the pipeline assembly 1, and the switching assembly 2 includes a sealing piston 21, which may be moved reciprocally.

The matching part 13 is an annular sealing part, and the sealing piston 21 is configured to be abutted against the annular sealing part to discommunicate the sewage discharge channel 11, or separated from the annular sealing part to communicate the sewage discharge channel 11.

The mounting cavity 17 is provided in the pipeline assembly 1, and may be configured for mounting a switching assembly 2. The mounting cavity 17 may be communicated with the sewage discharge channel 11, so that the sealing piston 21 of the switching assembly 2 may move into the sewage discharge channel 11, and an edge area of an end face of the sealing piston 21 may be abutted against the annular matching part 13, thereby realizing a sealing cooperation between the sealing piston 21 and the matching part 13 to discommunicate the sewage discharge channel 11. At this time, the water seal channel 12 may conduct a water seal. The sealing piston 21 may also be moved to separate the end face thereof from the annular matching part 13, and at this time, the sewage discharge channel 11 is communicated, so that sewage discharge may be realized.

In some exemplary embodiments, a communication part between the mounting cavity 17 and the sewage discharge channel 11 is located downstream of the annular sealing part. The sealing piston 21 is configured to seal the mounting cavity 17 when separated from the annular sealing part so as to disconnect the mounting cavity 17 from the sewage discharge channel 11.

After the sealing piston 21 is separated from the annular matching part 13, the sealing piston 21 may move until the mounting cavity 17 is sealed, so that the mounting cavity 17 is discommunicated with the sewage discharge channel 11, and sewage is prevented from flowing into the mounting cavity 17 during sewage discharge. Further/alternatively, a sealing element may be provided at the mounting cavity 17 in order to prevent sewage in the sewage discharge channel 11 from flowing into the mounting cavity 17 or leaking at the mounting cavity 17.

Figure 23:
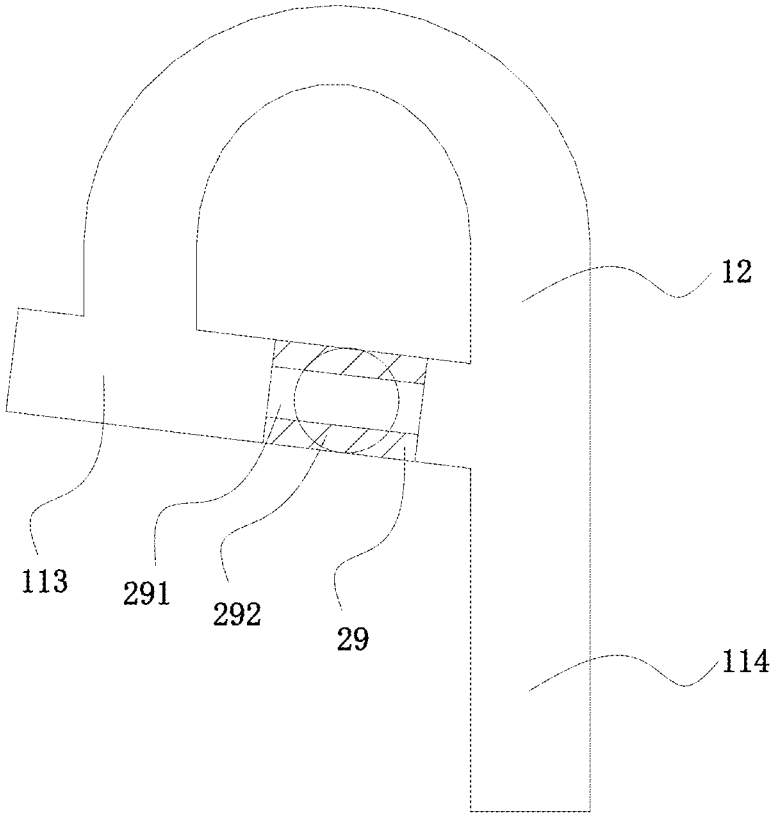
FIG. 23 is a schematic sectional view of a structure of a sewage discharge device according to a further embodiment of the present application.

It should be understood that the switching assembly 2 is not limited to a switching assembly in the form of a sealing piston 21, but may also be in other forms. As shown in FIG. 23, the switching assembly 2 may include a ball valve 29, and the ball valve 29 includes a flow passage 291 and a rotatable valve core 292. The valve core 292 is configured to control the communication and discommunication of the flow passage 291 by rotation. In this case, the matching part 13 which matches with the switching assembly 2 may be a mounting part for the ball valve 29, and the ball valve 29 and the matching part 13 are in a sealing cooperation to prevent leakage at the gap between the ball valve 29 and the matching part 13. Portions of the sewage discharge channel 11 located on two sides of the matching part 13 (i.e., portions located upstream and downstream of the matching part 13) may be respectively communicated with two ends of the flow passage 291, so as to control the communication and discommunication of the flow passage 291 in the ball valve 29 by rotation of the valve core 292, and further control the communication and discommunication of the sewage discharge channel 11 by the communication and discommunication of the flow passage 291.

In some exemplary embodiments, as shown in FIGS. 9, 11-12, and 15, the sewage discharge channel 11 has an inverted L-shape, the mounting cavity 17 and the first sewage discharge sub-channel 113 are respectively provided on two sides of the second sewage discharge sub-channel 114, and a communication part between the first sewage discharge sub-channel 113 and the second sewage discharge sub-channel 114 is also communicated with the mounting cavity 17. A central axis of the mounting cavity 17 may be collinear with a central axis of the first sewage discharge sub-channel 113, so that the mounting cavity 17, the first sewage discharge sub-channel 113, and the second sewage discharge sub-channel 114 may be substantially T-shaped as a whole.

In some exemplary embodiments, as shown in FIGS. 6, 9, 11-12, and 15, the sealing piston 21 includes a sealing rubber pad 211 and a rubber pad bracket 212. The sealing rubber pad 211 is mounted to the rubber pad bracket 212, and the sealing rubber pad 211 is configured to be abutted against the matching part 13 to discommunicate the sewage discharge channel 11, or to be separated from the matching part 13 to communicate the sewage discharge channel 11.

In the sealing piston 21, the sealing rubber pad 211 is mounted to the rubber pad bracket 212, and the sealing rubber pad 211 with elasticity may be supported by the rubber pad bracket 212. The sealing rubber pad 211 may be abutted against and matched with or separated from the matching part 13, and the discommunication or communication of the sewage discharge channel 11 is realized, so that the sewage discharge device is switched between the sewage discharge function and the water seal function.

In some exemplary embodiments, as shown in FIGS. 6, 9, 11-12, and 15, the rubber pad bracket 212 has a cylindrical shape, one end of which is open, and one end of which is closed. The sealing rubber pad 211 is sleeved outside a closed end of the rubber pad bracket 212.

The rubber pad bracket 212 has a cylindrical shape, one end of which is open, and one end of which is closed. The sealing rubber pad 211 is sleeved outside the closed end of the rubber pad bracket 212. As a result, the sealing rubber pad 211 is effectively supported by the rubber pad bracket 212, and when the sealing rubber pad 211 is abutted against and matched with the matching part 13, the sealing rubber pad 211 is pressed by the rubber pad bracket 212 and the matching part 13 to ensure a sealing cooperation between the sealing rubber pad 211 and the matching part 13. A sealing element (for example, an O-ring or the like) may be provided between an outer wall surface of the rubber pad bracket 212 and an inner wall surface of the mounting cavity 17 and is configured to prevent leakage at the mounting cavity 17 after the mounting cavity 17 is communicated with the sewage discharge channel 11.

In some exemplary embodiments, the switching assembly 2 further includes a drive assembly, and the drive assembly is connected to the sealing piston 21 and capable of driving the sealing piston 21 to reciprocate.

The drive assembly may be connected with the rubber pad bracket 212 of the sealing piston 21, so that the drive assembly drives the rubber pad bracket 212 to reciprocate, and in turn drives the sealing rubber pad 211 to move, the sealing rubber pad 211 may be abutted against and matched with or be separated from the matching part 13, thereby realizing the discommunication or communication of the sewage discharge channel 11.

In some exemplary embodiments, as shown in FIGS. 6, 9, 11-12, and 15, the drive assembly includes an electric telescopic rod 22, and the electric telescopic rod 22 includes a telescopic end. The telescopic end can move reciprocally and telescopically, and the telescopic end may be connected to the sealing piston 21.

The telescopic end of the electric telescopic rod 22 may be extended into the cylindrical rubber pad bracket 212, and is fixedly connected to the rubber pad bracket 212 through the fixing block 221, so that when the telescopic end of the electric telescopic rod 22 is moved telescopically, the rubber pad bracket 212 and the sealing rubber pad 211 mounted to the rubber pad bracket 212 are driven to move reciprocally, thus realizing that the sealing rubber pad 211 is abutted against and matched with or separated from the matching part 13.

As shown in FIGS. 6, 9, 11-12, and 15, the switching assembly 2 further includes an end cap 23, the end cap 23 is fixedly connected to the pipeline main body 14 and closes an opening at one end of the mounting cavity 17 away from the sewage discharge channel 11. The electric telescopic rod 22 may be mounted to the end cap 23, and the telescopic end of the electric telescopic rod 22 may be fixedly connected to the rubber pad bracket 212.

When the toilet starts a flushing function, a water pump 5 (described in detail below) of the toilet may pump water from a water tank 4 (described in detail below), and water flow enters a urinal through a brush ring water inlet 31 (described in detail below) to flush the urinal. At the same time, the electric telescopic rod 22 is retracted to open the sewage discharge channel 11, so as to realize the functions of moistening and washing the urinal and flushing and sewage discharge.

When the sewage discharge is completed, the electric telescopic rod 22 is elongated, the sealing rubber pad 211 seals and blocks the sewage discharge channel 11, and water continuously inflows from the brush ring water inlet 31, so that excess water overflows from the water seal channel 12. At the same time, an overflow point of the water seal channel 12 is above the water seal level H, so that there is enough water in the urinal to meet a water seal requirement.

Figure 16:
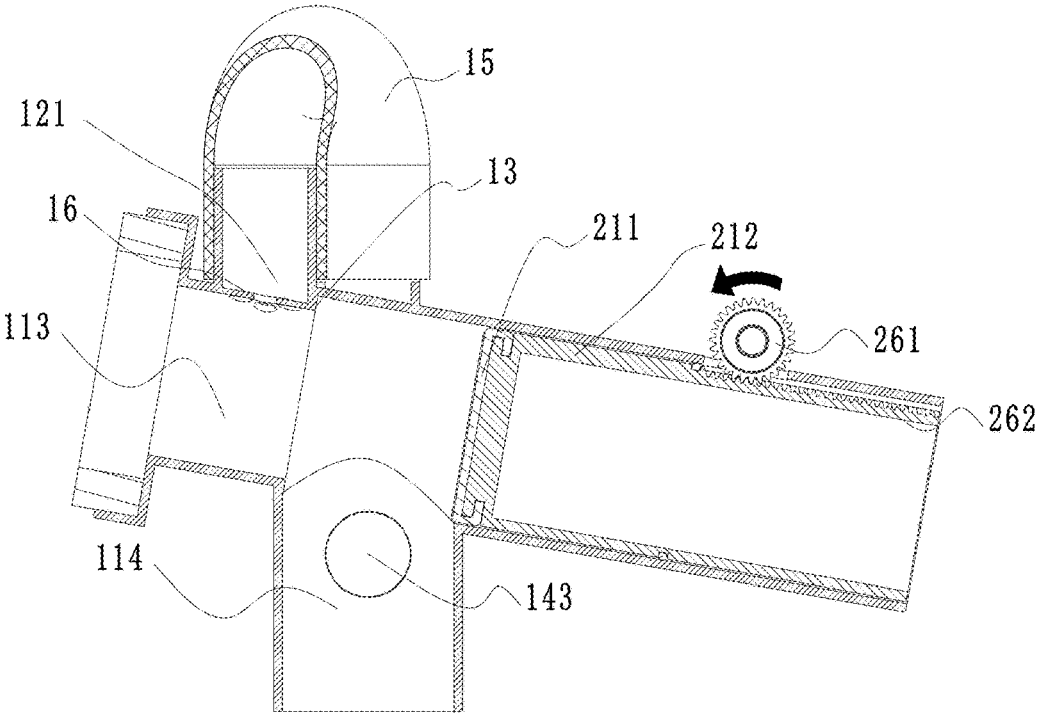
FIG. 16 is a schematic sectional view of a structure of a sewage discharge device of a toilet according to yet another embodiment of the present application, in which the sewage discharge channel is communicated.
Figure 17:
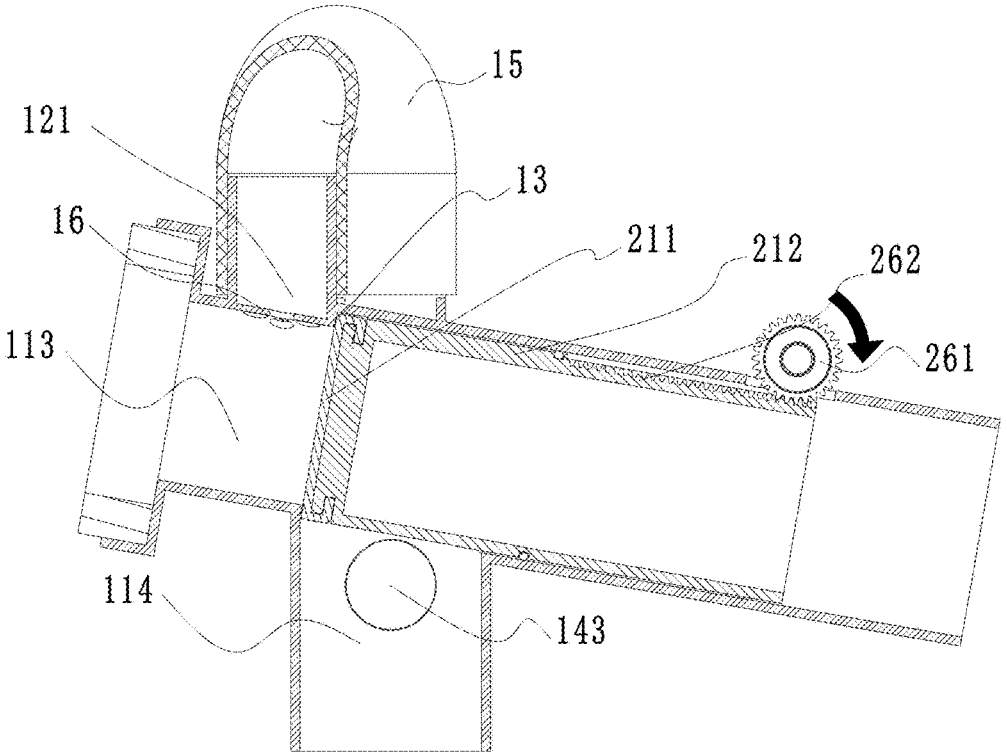
FIG. 17 is another schematic sectional view of a structure of the sewage discharge device shown in FIG. 16, in which the sewage discharge channel is discommunicated.
Figure 18:
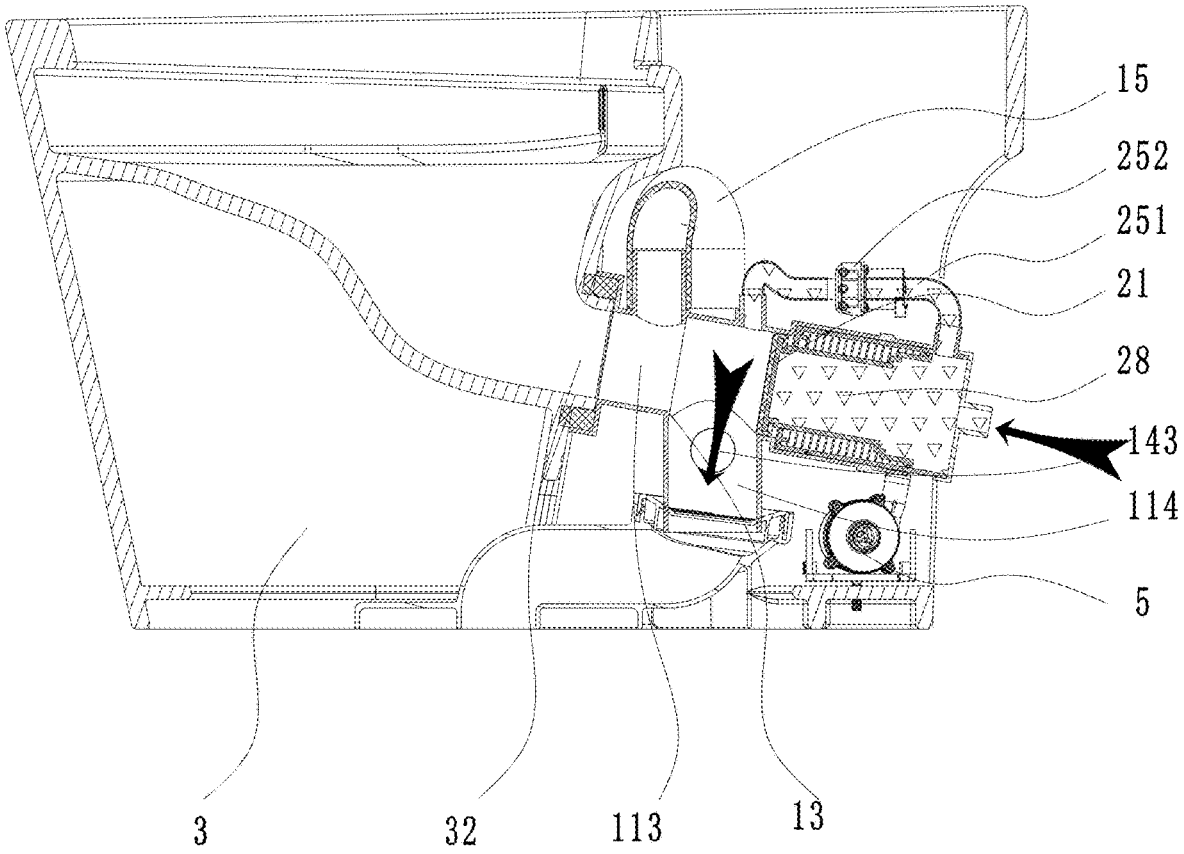
FIG. 18 is a schematic sectional view of a structure of a toilet according to still another embodiment of the present application, in which the sewage discharge channel is communicated.
Figure 19:
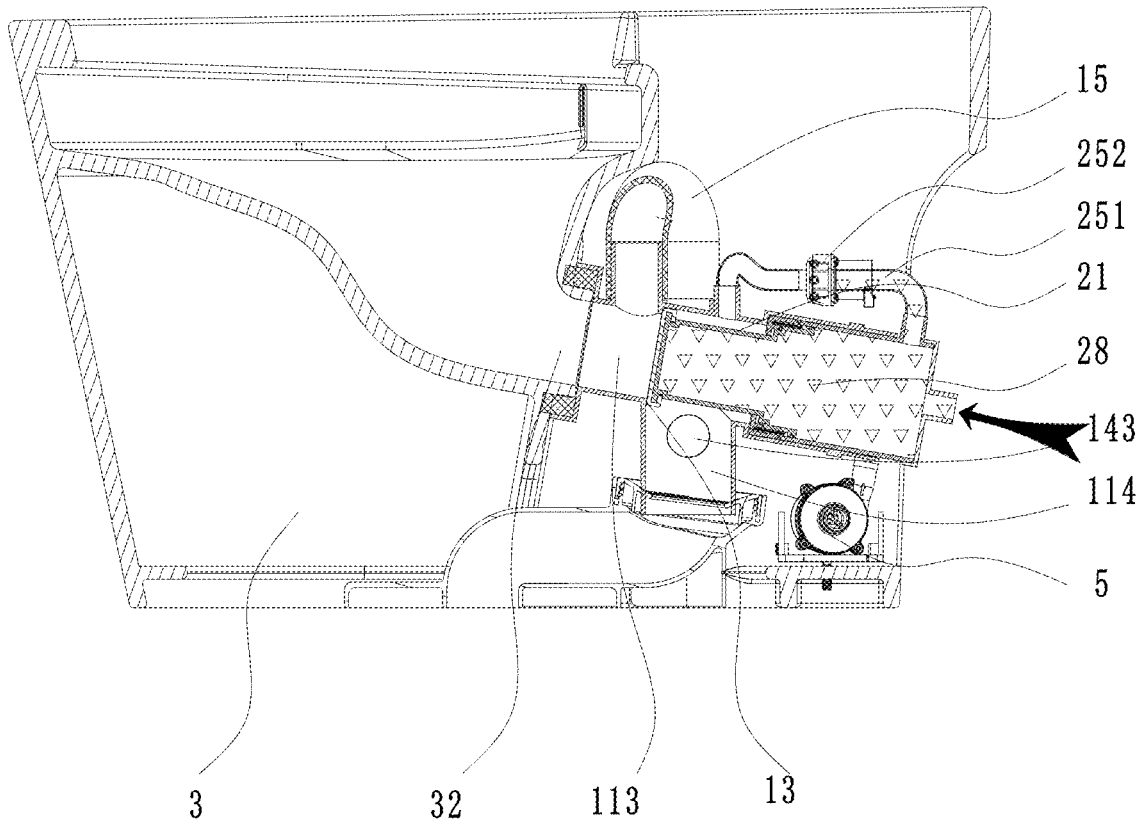
FIG. 19 is another schematic sectional view of a structure of the toilet shown in FIG. 18, in which the sewage discharge channel is discommunicated.
Figure 20:
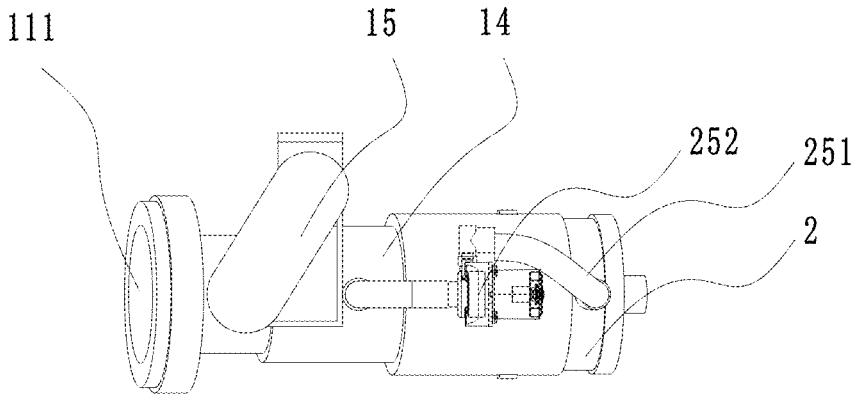
FIG. 20 is a schematic view of a structure of a sewage discharge device of the toilet shown in FIG. 18.
Figure 21:
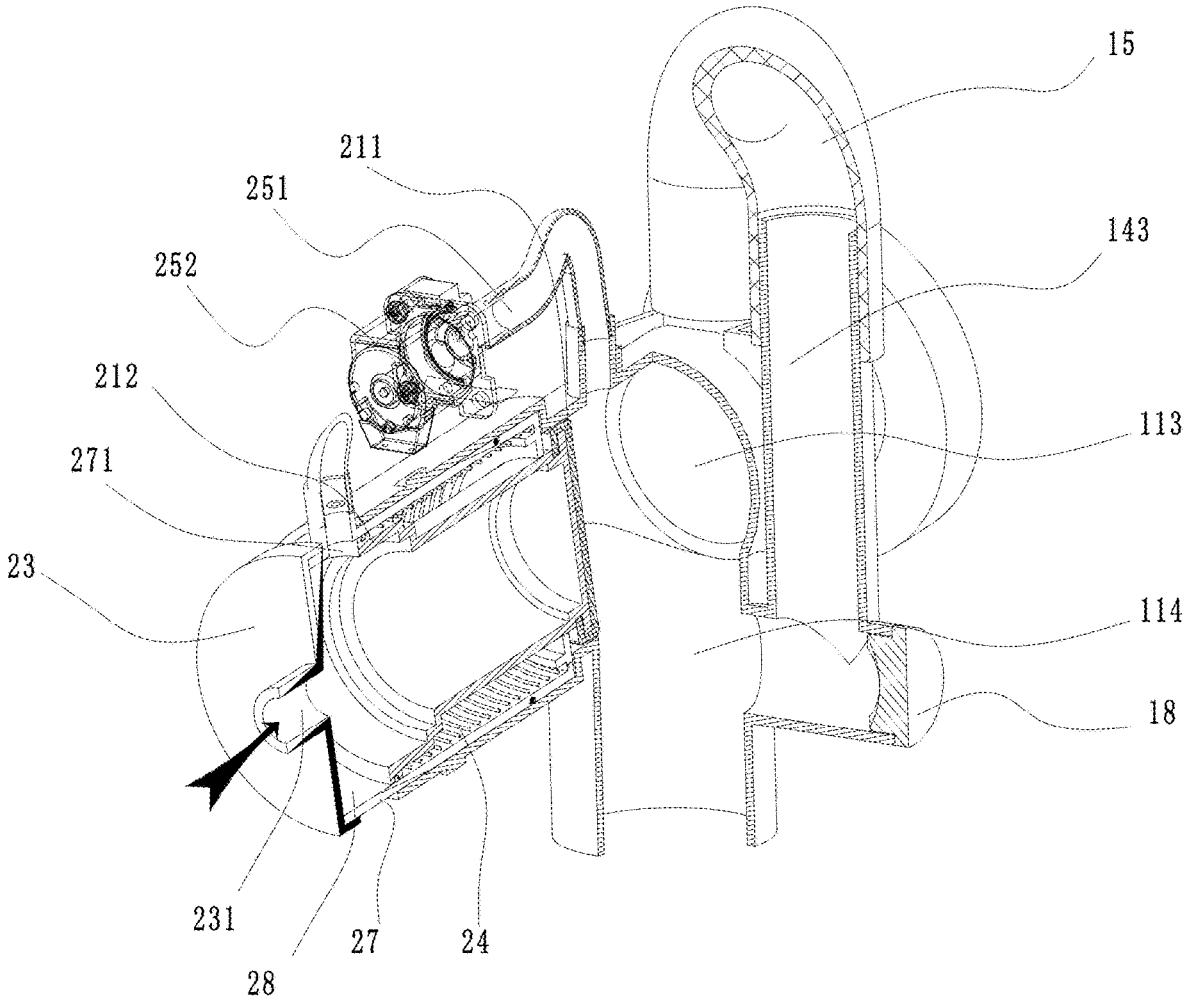
FIG. 21 is a first schematic sectional view of a structure of the sewage discharge device shown in FIG. 20, in which the sewage discharge channel is communicated.
Figure 22:
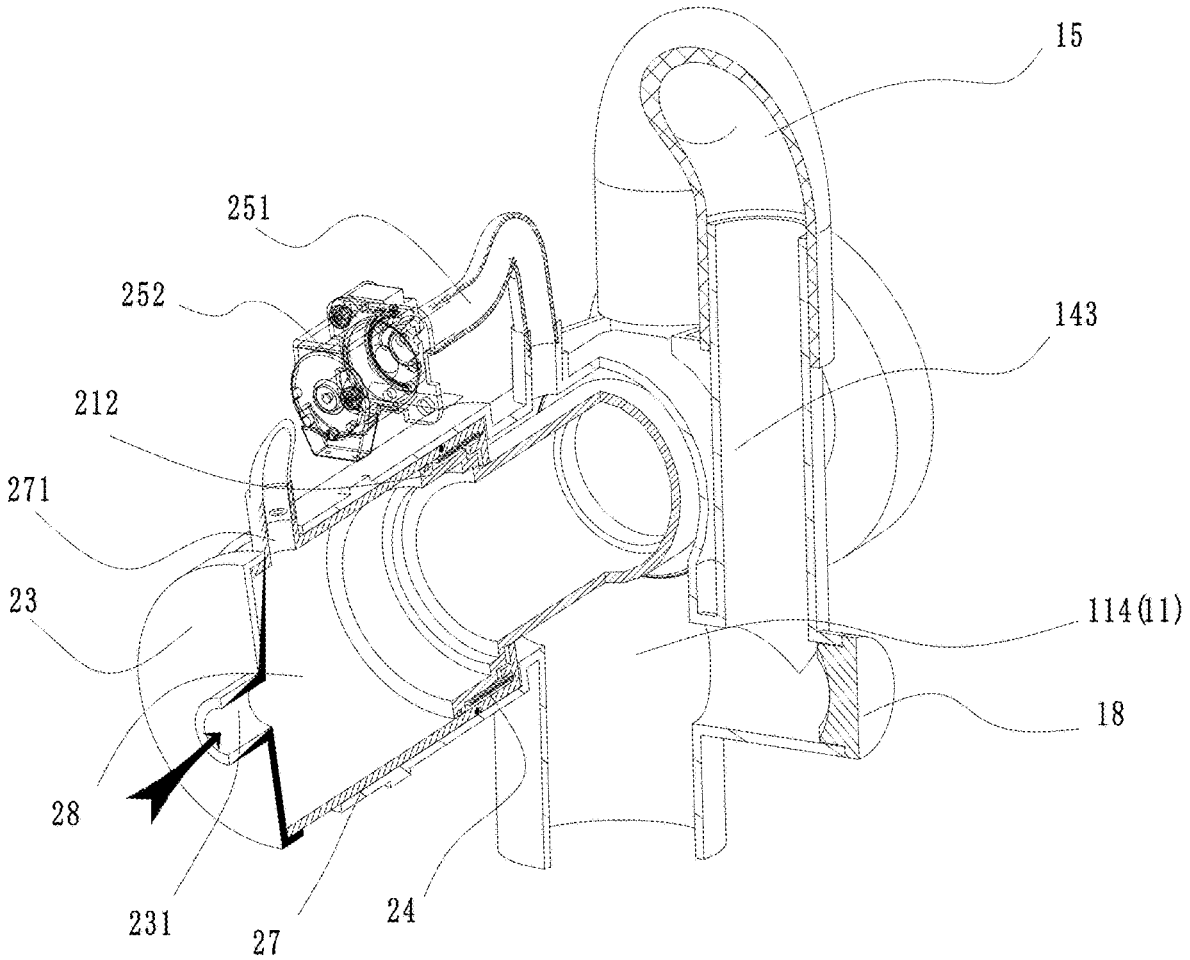
FIG. 22 is a second schematic sectional view of a structure of the sewage discharge device shown in FIG. 20, in which the sewage discharge channel is discommunicated.

In yet some exemplary embodiments, as shown in FIGS. 16 and 17, the drive assembly includes a drive element, a gear 261, and a rack 262. The drive element is connected to the gear 261 and capable of driving the gear 261 to rotate, the gear 261 is meshed and mated with the rack 262, and the rack 262 is connected to the sealing piston 21.

A connection between the drive element and the rubber pad bracket 212 of the sealing piston 21 is realized through a transmission mechanism formed by the gear 261 and the rack 262, so that when the drive element drives the gear 261 to rotate forwardly and reversely, the rack 262 drives the rubber pad bracket 212 and the sealing rubber pad 211 mounted to the rubber pad bracket 212 to move reciprocally, thus realizing that the sealing rubber pad 211 is abutted against and matched with or separated from the matching part 13.

In this solution, by utilizing a matched transmission between the gear 261 capable of rotating forwardly and reversely and the rack 262 mounted to the rubber pad bracket 212, the rubber pad bracket 212 is driven to move reciprocally, so that the opening and closing of the sewage discharge channel 11 is realized. When the gear 261 is rotated reversely (or rotated forwardly), the rubber pad bracket 212 moves and retracts into the mounting cavity 17 to communicate the sewage discharge channel 11, and the sewage discharge function is realized. When the gear 261 is rotated forwardly (or rotated reversely), the rubber pad bracket 212 moves and extends out of the mounting cavity 17 to close the sewage discharge channel 11, and the water seal function is realized.

The drive element may be a manual drive element or an electric drive element (for example a motor, or the like).

The rack 262 and the rubber pad bracket 212 may be of a split structure and fixedly connected, or, as shown in FIGS. 16 and 17, the rack 262 and the rubber pad bracket 212 may be of an integrated structure to reduce a quantity of parts and simplify the assembly process.

In still some exemplary embodiments, as shown in FIGS. 18-22, the switching assembly 2 further includes a cylinder body and an elastic element 24, the cylinder body is fixed within the mounting cavity 17 and cooperated with the sealing piston 21 to form a sealing cavity 28. The sealing cavity 28 is configured for accommodating fluid and has a fluid inlet-outlet, and the elastic element 24 is provided between the cylinder body and the sealing piston 21.

The sealing piston 21 is configured to be in one of abutting against and separating from the matching part 13 under an action of the elastic element 24, and further configured to overcome an elastic motion of the elastic element 24 and be in the other of abutting against and separating from the matching part 13 under an action of fluid that enters the sealing cavity 28.

The switching assembly 2 includes a sealing piston 21, a cylinder body and an elastic element 24. The cylinder body is fixed in the mounting cavity 17 of the pipeline assembly 1, the sealing piston 21 may be displaced reciprocally within the mounting cavity 17, and the cylinder body and the cylindrical sealing piston 21 may cooperate to form a sealing cavity 28. The sealing cavity 28 has a fluid inlet-outlet, through which a fluid with a certain pressure (such as water or air) may enter the sealing cavity 28 or discharge from the sealing cavity 28. An elastic element 24 is further provided between the cylinder body and the sealing piston 21, so that the sealing piston 21 can be subjected to an elastic force of the elastic element 24 and a pressure of the fluid in the sealing cavity 28. When the elastic force of the elastic element 24 is greater than the pressure of the fluid, the sealing piston 21 moves in one direction until it abuts against and matches with (or separates from) the matching part 13. When the pressure of the fluid is greater than the elastic force of the elastic element 24, the sealing piston 21 moves in an opposite direction until it separates from (or abuts against and matches with) the matching part 13.

In this exemplary embodiment, as shown in FIGS. 18-22, the fluid inlet-outlet may include a fluid inlet 231 and a fluid outlet 271, and the switching assembly 2 may further include a pressure relief channel 251 and a pressure relief valve 252. Two ends of the pressure relief channel 251 are respectively communicated with the fluid outlet 271 and a portion of the sewage discharge channel 11 located downstream of the matching part 13, and the pressure relief valve 252 is provided in the pressure relief channel 251 and controls the communication and discommunication of the pressure relief channel 251.

The sealing cavity 28 is provided with a fluid inlet 231 and a fluid outlet 271, fluid may enter the sealing cavity 28 through the fluid inlet 231, so that a pressure of the fluid may be increased to be greater than an elastic force of the elastic element 24; fluid may be discharged from the sealing cavity 28 through the fluid outlet 271, so that a pressure of the fluid may be reduced to be less than an elastic force of the elastic element 24. As a result, the sealing piston 21 may be moved reciprocally under an action of the pressure of the fluid and an action of the elastic force of the elastic element 24. The pressure relief channel 251 is connected between the fluid outlet 271 and a portion of the sewage discharge channel 11 located downstream of the matching part 13, so that fluid discharged from the sealing cavity 28 through the fluid outlet 271 is discharged to the sewage discharge channel 11 through the pressure relief channel 251, and a pressure relief of the sealing cavity 28 is realized. The pressure relief channel 251 is provided with a pressure relief valve 252 to control the communication and discommunication of the pressure relief channel 251, thereby controlling a discharge of fluid in the sealing cavity 28.

As shown in FIGS. 18-22, the cylinder body includes an end cap 23 and a fixing seat 27. The fixing seat 27 has a cylindrical shape with openings at two ends. The end cap 23 is fixed at an opening at one end of the fixing seat 27 and seals the opening. The cylindrical rubber pad bracket 212 of the sealing piston 21 may be inserted into the fixing seat 27 from an opening at the other end of the fixing seat 27 and may be moved relative to the fixing seat 27. A sealing element (for example, an O-ring, or the like) is provided between the fixing seat 27 and the rubber pad bracket 212, so that the end cap 23, the fixing seat 27, and the rubber pad bracket 212 cooperate to form the sealing cavity 28. The end cap 23 is provided with a fluid inlet 231, and a fluid outlet 271 is provided at one end of the fixing seat 27 close to the end cap 23. The elastic element 24 may be a spring and is disposed between the fixing seat 27 and the rubber pad bracket 212.

In this solution, the sealing cavity 28 with a chamber is formed and a rubber pad bracket 212 is slidable therein by assembling the rubber pad bracket 212, the end cap 23, the fixing seat 27, the sealing element, and the like. The pressurized water is injected into the sealing cavity 28 through the fluid inlet 231 of the end cap 23, and further, by utilizing a telescopic characteristic of the spring and the activate and deactivate of the pressure relief function of the pressure relief valve 252, a reciprocating movement function of the rubber pad bracket 212 is realized, so that the opening and closing of the sewage discharge channel 11 are realized.

When the sewage discharge function is turned on, the pressure relief valve 252 is turned on, the water pressure in the sealing cavity 28 decreases, an elastic force of the spring pushes the rubber pad bracket 212 to retract, and the sewage discharge channel 11 is communicated and sewage is discharged. When the sewage discharge function is turned off, the pressure relief valve 252 is turned off, pressurized water injected from the fluid inlet 231 enters the sealing cavity 28, the rubber pad bracket 212 is pushed to move and compress the spring, and the rubber pad bracket 212 extends outside, and the sealing rubber pad 211 is driven to press tightly against the matching part 13, which plays a sealing role.

As shown in FIGS. 1-22, an embodiment of the present application also provides a toilet, including a toilet body 3 and the sewage discharge device of the toilet according to any of the above embodiments. The toilet body 3 has a urinal and a sewage discharge port 32, the sewage discharge port 32 is provided at the bottom of the urinal and communicated with the urinal, and a first inlet end 111 of a sewage discharge channel 11 of the sewage discharge device and a second inlet end 121 of a water seal channel 12 of the sewage discharge device are both communicated with the sewage discharge port 32.

In some exemplary embodiments, as shown in FIGS. 1-4, the toilet further includes a water tank 4 and a water pump 5. The toilet body 3 further has a brush ring water inlet 31, the brush ring water inlet 31 is provided at an upper part of the urinal, a water inlet end of the water pump 5 is connected to the water tank 4, and a water outlet end of the water pump 5 is connected to the brush ring water inlet 31, so that water in the water tank 4 is pumped to the brush ring water inlet 31 through the water pump 5, and the urinal is flushed with water sprayed from the brush ring water inlet 31. The first outlet end 112 of the sewage discharge channel 11 may be communicated with the sewer channel to discharge sewage through the sewer channel.

Of course, the toilet may also be configured to exclude a water tank 4.

In some exemplary embodiments, the toilet body 3 may not have a spray port located at the bottom of the urinal to reduce noise generated when the toilet is flushed.

In summary, the toilet and the sewage discharge device provided by the embodiments of the present application utilize a dual waterway system to realize a separation between a sewage discharge channel and a water seal channel, which can not only meet the functions of sewage discharge and water seal, but also reduce the forming process of the toilet body and reduce the cost. A switching assembly is utilized to control the communication of the sewage discharge channel to control sewage discharge, so that a speed of sewage discharge is faster and the sewage discharge is smoother. The spray port at the bottom of the toilet body is eliminated to reduce noise generated when water is sprayed.

In the description of this specification, descriptions with reference to terms "one implementation", "certain implementations", "schematic implementations", "examples", "specific examples", or "some examples" and the like mean that specific features, structures, materials, or characteristics described in conjunction with the embodiments or examples are included in at least one implementation or example of the embodiments of the present application. In this specification, schematic representations of the above terms do not necessarily refer to the same implementations or examples. Further, the specific features, structures, materials, or characteristics described may be combined in a suitable manner in any one or more implementations or examples.

Although implementations disclosed herein are described above, the described contents are only implementations used for facilitating understanding of the present application, and are not intended to limit the present application. Without departing from the spirit and scope disclosed herein, any person skilled in the art to which the present application pertains may make any modifications and changes in the form and details of implementation, but the scope of patent protection of the present application shall still be defined by the appended claims.

The invention claimed is:

1. A sewage discharge device of a toilet, comprising a pipeline assembly and a switching assembly, wherein the pipeline assembly comprises a water seal channel and a sewage discharge channel, the sewage discharge device has a sewage discharge state and a water seal state, in the sewage discharge state, the sewage discharge channel is configured for discharging sewage from the toilet, and in the water seal state, the water seal channel is configured to water-seal the toilet; and the switching assembly is configured to control the sewage discharge device to switch between the sewage discharge state and the water seal state;

wherein a matching part is provided in the sewage discharge channel, and the switching assembly is configured to cooperate with the matching part to control communication or discommunication of the sewage discharge channel;

an inlet end of the water seal channel is communicated with a portion of the sewage discharge channel located upstream of the matching part, and a highest point of the water seal channel is higher than a highest point of the sewage discharge channel;

wherein when the sewage discharge channel is discommunicated, the water seal channel is configured to water-seal the toilet, and when the sewage discharge channel is communicated, the sewage discharge channel is configured for discharging sewage from the toilet, wherein the pipeline assembly comprises a pipeline main body and a U-shaped tube, wherein the pipeline main body is provided with the sewage discharge channel, and a first port and a second port, the first port and the second port are communicated with the sewage discharge channel, the first port and the second port are respectively located upstream and downstream of the matching part, two ends of the U-shaped tube are respectively communicated with the first port and the second port;

wherein the U-shaped tube is a hose, and two ends of the U-shaped tube are respectively sleeved outside the first port and the second port and are interference-fitted with the first port and the second port.

2. The sewage discharge device of the toilet according to claim 1, wherein an outlet end of the water seal channel is communicated with a portion of the sewage discharge channel located downstream of the matching part.

3. The sewage discharge device of the toilet according to claim 2, wherein a channel in the U-shaped tube forms the water seal channel.

4. The sewage discharge device of the toilet according to claim 3, wherein the sewage discharge channel comprises a first sewage discharge sub-channel provided transversely and a second sewage discharge sub-channel provided vertically, the first sewage discharge sub-channel and the second sewage discharge sub-channel are connected in an inverted L-shape, and both the first port and the second port are communicated with the first sewage discharge sub-channel.

5. The sewage discharge device of the toilet according to claim 2, wherein the pipeline main body is further provided with a first water seal sub-channel, wherein the first port is communicated with a portion of the sewage discharge channel located upstream of the matching part, the second port is communicated with a portion of the sewage discharge channel located downstream of the matching part through the first water seal sub-channel, and a channel in the U-shaped tube and the first water seal sub-channel form the water seal channel.

6. The sewage discharge device of the toilet according to claim 5, wherein the sewage discharge channel comprises a first sewage discharge sub-channel provided transversely and a second sewage discharge sub-channel provided vertically, the first sewage discharge sub-channel and the second sewage discharge sub-channel are connected in an inverted L-shape, the first port is communicated with the first sewage discharge sub-channel, and the first water seal sub-channel is communicated with the second sewage discharge sub-channel.

7. The sewage discharge device of the toilet according to claim 1, wherein an inlet end of the water seal channel is provided with a filter screen.

8. The sewage discharge device of the toilet according to claim 1, wherein the switching assembly comprises a switching component, the switching component is configured to be able to rotate or translate to switch between a first position and a second position; when the switching component is in the first position, the sewage discharge channel is discommunicated, and when the switching component is in the second position, the sewage discharge channel is communicated.

9. The sewage discharge device of the toilet according to claim 8, wherein the matching part is an annular sealing part, the switching component comprises a sealing piston which is movable reciprocally, the sealing piston is configured to be capable of abutting against the annular sealing part to discommunicate the sewage discharge channel, or capable of separating from the annular sealing part to communicate the sewage discharge channel.

10. The sewage discharge device of the toilet according to claim 9, wherein a mounting cavity for mounting the switching assembly is provided in the pipeline assembly, the mounting cavity is communicated with the sewage discharge channel, and a communication part between the mounting cavity and the sewage discharge channel is located downstream of the annular sealing part; and the sealing piston is configured to seal the mounting cavity when separated from the annular sealing part so as to disconnect the mounting cavity from the sewage discharge channel.

11. The sewage discharge device of the toilet according to claim 9, wherein the switching assembly further comprises a drive assembly, and the drive assembly is connected to the sealing piston and capable of driving the sealing piston to reciprocate.

12. The sewage discharge device of the toilet according to claim 11, wherein the drive assembly comprises an electric telescopic rod, and a telescopic end of the electric telescopic rod is connected to the sealing piston; or the drive assembly comprises a drive element, a gear, and a rack, the drive element is connected with the gear and configured to drive the gear to rotate, the gear is meshed and mated with the rack, and the rack is connected to the sealing piston.

13. The sewage discharge device of the toilet according to claim 9, wherein the switching assembly further comprises a cylinder body and an elastic element, the cylinder body is cooperated with the sealing piston to form a sealing cavity, the sealing cavity is configured for accommodating fluid and has a fluid inlet-outlet, and the elastic element is provided between the cylinder body and the sealing piston;

the sealing piston is configured to be in one of abutting against and separating from the matching part under an action of the elastic element, and further configured to overcome an elastic motion of the elastic element and be in the other of abutting against and separating from the matching part under an action of fluid that enters the sealing cavity.

14. The sewage discharge device of the toilet according to claim 13, wherein the fluid inlet-outlet comprises a fluid inlet and a fluid outlet, and the switching assembly further comprises a pressure relief channel and a pressure relief valve, two ends of the pressure relief channel are respectively communicated with the fluid outlet and a portion of the sewage discharge channel located downstream of the matching part, and the pressure relief valve is provided in the pressure relief channel and controls communication and discommunication of the pressure relief channel.

15. The sewage discharge device of the toilet according to claim 9, wherein the sealing piston comprises a sealing rubber pad and a rubber pad bracket, the rubber pad bracket has a cylindrical shape, one end of which is open, and one end of which is closed; the sealing rubber pad is sleeved outside a closed end of the rubber pad bracket.

16. The sewage discharge device of the toilet according to claim 8, wherein the switching assembly comprises a ball valve, the ball valve comprises a flow passage and a rotatable valve core, and the valve core is configured to control communication and discommunication of the flow passage through rotation;

the matching part is a mounting part for the ball valve, and portions of the sewage discharge channel located on two sides of the matching part are respectively communicated with two ends of the flow passage.

17. A toilet, characterized by comprising a toilet body and the sewage discharge device of the toilet according to claim 1, wherein the toilet body has a sewage discharge port, and an inlet end of the sewage discharge channel of the sewage discharge device and the inlet end of the water seal channel of the sewage discharge device are both communicated with the sewage discharge port.

* * * * *